US010495402B2

(12) United States Patent
Morris et al.

(10) Patent No.: US 10,495,402 B2
(45) Date of Patent: Dec. 3, 2019

(54) FIREARM BENCH BLOCK

(71) Applicant: Revo Brand Group, LLC, Plymouth, MN (US)

(72) Inventors: Matt Morris, Minneapolis, MN (US); Ryan Jacobson, Minneapolis, MN (US)

(73) Assignee: Revo Brand Group, LLC, Plymouth, MN (US)

( * ) Notice: Subject to any disclaimer, the term of this patent is extended or adjusted under 35 U.S.C. 154(b) by 0 days.

(21) Appl. No.: 16/119,491

(22) Filed: Aug. 31, 2018

(65) Prior Publication Data

US 2019/0063863 A1 Feb. 28, 2019

Related U.S. Application Data

(60) Provisional application No. 62/552,577, filed on Aug. 31, 2017.

(51) Int. Cl.

| | |
|---|---|
| ***F41C 27/00*** | (2006.01) |
| ***F41A 23/18*** | (2006.01) |
| *F41A 11/00* | (2006.01) |

(52) U.S. Cl.

CPC ..... *F41A 23/18* (2013.01); *F41A 11/00* (2013.01)

(58) Field of Classification Search

CPC ..... F41A 23/18; F41A 11/00; F41A 29/00; F41A 35/00; F41C 27/00

USPC ..... 42/94, 90; 89/37.04; 73/167

See application file for complete search history.

(56) References Cited

U.S. PATENT DOCUMENTS

| | | | | |
|---|---|---|---|---|
| 3,041,938 | A | 7/1962 | Seabrook | |
| 5,720,193 | A * | 2/1998 | Dick | E05B 37/00 211/64 |
| 6,230,430 | B1 | 5/2001 | Gosselin | |
| 8,209,896 | B1 | 7/2012 | Cashwell | |
| 9,194,653 | B1 | 11/2015 | Jenkinson et al. | |
| 9,328,983 | B2 | 5/2016 | Wilkinson | |
| 9,383,157 | B2 | 7/2016 | Folk | |
| 10,337,822 | B2 * | 7/2019 | Hofman | |

(Continued)

OTHER PUBLICATIONS

Wheeler Engineering, "Delta Series AR-15 Armorer's Bench Block," product listing, www.btibrands.com/product/ar-armorers-bench-block, 3 pp.

(Continued)

*Primary Examiner* — Michael D David

(74) *Attorney, Agent, or Firm* — Grumbles Law PLLC; Brittany Nanzig

(57) ABSTRACT

A firearm bench block can include a receiving core and a non-slip frame. The core can include a recess on its top side configured to securely receive a firearm component for maintenance. The core can include a hole positioned so that when the component is securely received by the recess, the hole is aligned with a corresponding pin of the component. When the pin is punched from the component, the pin can pass through the hole from the top to the bottom of the core. The frame can be structured to substantially surround the core. The frame can have a bottom edge that lays substantially in a plane and is displaced from the bottom side of the core such when the bottom edge of the frame rests against a flat surface, the frame retains the pin to a space bounded at least by the frame and the flat surface.

19 Claims, 23 Drawing Sheets

(56) References Cited

U.S. PATENT DOCUMENTS

| | | | | |
|---|---|---|---|---|
| 2009/0064560 | A1* | 3/2009 | Saunders, III | F41A 23/18 42/94 |
| 2011/0035983 | A1 | 2/2011 | Conti | |
| 2018/0058796 | A1* | 3/2018 | Hofman | F41A 29/02 |
| 2018/0087863 | A1 | 3/2018 | Sexton | |
| 2019/0162499 | A1* | 5/2019 | Jacobson | F41A 23/18 |

OTHER PUBLICATIONS

Present Arms, Inc., "GM-102 Gunner's Mount," product listing, https://presentarmsinc.com/products/gunners-mount, 4 pp.
Wager Industries, Inc., "Magnetic Soft Jaws," product listing, https://www.brownells.com/gunsmith-tools-supplies/general-gunsmith-tools/vises-accessories/vise-jaws/magnetic-soft-jaws-prod22513.aspx, 2 pp.
Wheeler Engineering, "Wheeler Universal Bench Block," product listing, https://www.sears.com/wheeler-20INC&prdNo=3&blockNo=3&blockType=G3; 3 pp.

* cited by examiner

FIREARM BENCH BLOCK

CROSS-REFERENCE TO RELATED APPLICATIONS

This application claims the benefit of U.S. Provisional Application Ser. No. 62/552,577, filed on Aug. 31, 2017, titled FIREARM BENCH BLOCK.

FIELD OF THE INVENTION

This disclosure relates to firearm maintenance aids, and more particularly, relates to bench blocks for firearm maintenance.

BACKGROUND OF THE INVENTION

During maintenance activities, firearms such as handguns or rifles are often handheld, clamped in a vise, or simply laid on a surface such as a benchtop. Each of these alternatives can have drawbacks. For example, handholding obviously can occupy one or more of an armorer's hands, obviating their use for other tasks. Vises can mar or otherwise damage a workpiece. A firearm being worked upon while resting on a surface may slide undesirably. Additional disadvantages of the aforementioned firearm support schemes are known. It would be desirable to provide devices that can provide firm, non-damaging support for firearms during maintenance activities such as removing pins.

SUMMARY OF THE INVENTION

This disclosure relates to firearm maintenance aids, and more particularly, relates to bench blocks for firearm maintenance. In an illustrative but non-limiting example, the disclosure provides a firearm bench block that can include a receiving core and a non-slip frame. The receiving core can comprise a first material and have a top side and a bottom side. The receiving core can define at least a first recess on the top side that can be configured to securely receive a firearm component for performance of a maintenance operation. The receiving core can further define at least a first through-hole positioned so that when the firearm component is securely received by the first recess of the receiving core, the first through-hole is aligned with a corresponding first pin of the firearm component, such that when the first pin is punched from the firearm component, the first pin can pass through the first through-hole from the top side to the bottom side of the receiving core. The non-slip frame can comprise a second material and can be structured to substantially surround a perimeter of the receiving core. The non-slip frame also can have a bottom edge that lays substantially in a plane and is displaced from the bottom side of the receiving core such when the bottom edge of the non-slip frame rests against a flat surface, the non-slip frame can retain the first pin to a space bounded at least by the non-slip frame and the flat surface, when the first pin is present in said space.

In some examples, the firearm bench block can include at least one magnet integrated with at least one of the receiving core and the non-slip frame. The magnet(s) can have magnetic strength sufficient to retain the first pin to the bench block. In some cases, the magnet(s) can be embedded in at least one of the receiving core and the non-slip frame. In some cases, the magnet(s) can be adhered to at least one of the receiving core and the non-slip frame. In some cases, a magnet can be positioned to retain the first pin to the non-slip frame.

In some examples, the bottom edge of the non-slip frame, when resting against the flat surface, can substantially frictionally prevent slippage of the firearm bench block relative to the flat surface.

In some examples, the receiving core can further define, on the bottom side, a barrel bushing wrench.

In some examples, the block can have a perimeter substantially shaped as a regular pentagon. In some such cases, the block and components thereof (core and/or non-slip frame) can define concave gripping recesses corresponding to every side of the regular pentagon of the block.

In some examples, the non-slip frame of the block is overmolded around the receiving core, and the receiving core and the non-slip frame are structured and configured such that the non-slip frame and receiving core substantially cannot be non-destructively separated.

In another illustrative but non-limiting example, the disclosure provides a firearm bench block that can include a receiving core and a non-slip frame. The receiving core can comprise a first material and have a top side and a bottom side. The receiving core can define at least a first recess on the top side that can be configured to securely receive a firearm component for performance of a maintenance operation. The receiving core can further define at least a first through-hole positioned so that when the firearm component is securely received by the first recess of the receiving core, the first through-hole is aligned with a corresponding first pin of the firearm component, such that when the first pin is punched from the firearm component, the first pin can pass into the first hole from the top side. The non-slip frame can comprise a second material and can be structured to substantially surround a perimeter of the receiving core. The non-slip frame also can have a bottom edge that lays substantially in a plane, such that the bottom edge of the non-slip frame, when resting against a flat surface, substantially frictionally prevents slippage of the firearm bench block relative to the flat surface.

In some examples, the first hole can be a through-hole, such that when the first pin is punched from the firearm component, the first pin can pass through the first through-hole from the top surface to the bottom surface of the receiving core.

In some examples, the bottom edge of the non-slip frame can be displaced from the bottom surface of the receiving core such when the bottom edge of the non-slip frame rests against a flat surface, the non-slip frame can retain loose small parts to a space bounded at least by the non-slip frame and the flat surface.

In some examples, the block can further include at least one magnet integrated with either the receiving core or the non-slip frame, with the magnet having a magnetic strength sufficient to retain the first pin to the bench block. In some cases, the magnet can be positioned to retain the first pin to the first hole. In some cases, the magnet can be positioned to retain the first pin to the non-slip frame.

In some examples, the block can further include a threaded T-handle tool structured and configured to cooperate with a complementary tapped receiving opening of the receiving core, the receiving core being structured and configured such that an AR-15 bolt can be received by the receiving core and the threaded T-handle tool can be used to apply tension to a bolt ejector of the AR-15 bolt.

In some examples, the receiving core can include recesses configured to receive an AR-15 bolt, an AR-15 lower receiver, an AR-15 upper receiver, an AR-15 front sight, and an AR-15 charging handle. In some cases, the receiving core can include recesses configured to receive at least one of the AR-15 bolt, AR-15 lower receiver, AR-15 upper receiver, AR-15 front sight, and AR-15 charging handle in more than one orientation.

The above summary is not intended to describe each and every example or every implementation of the disclosure. The Description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
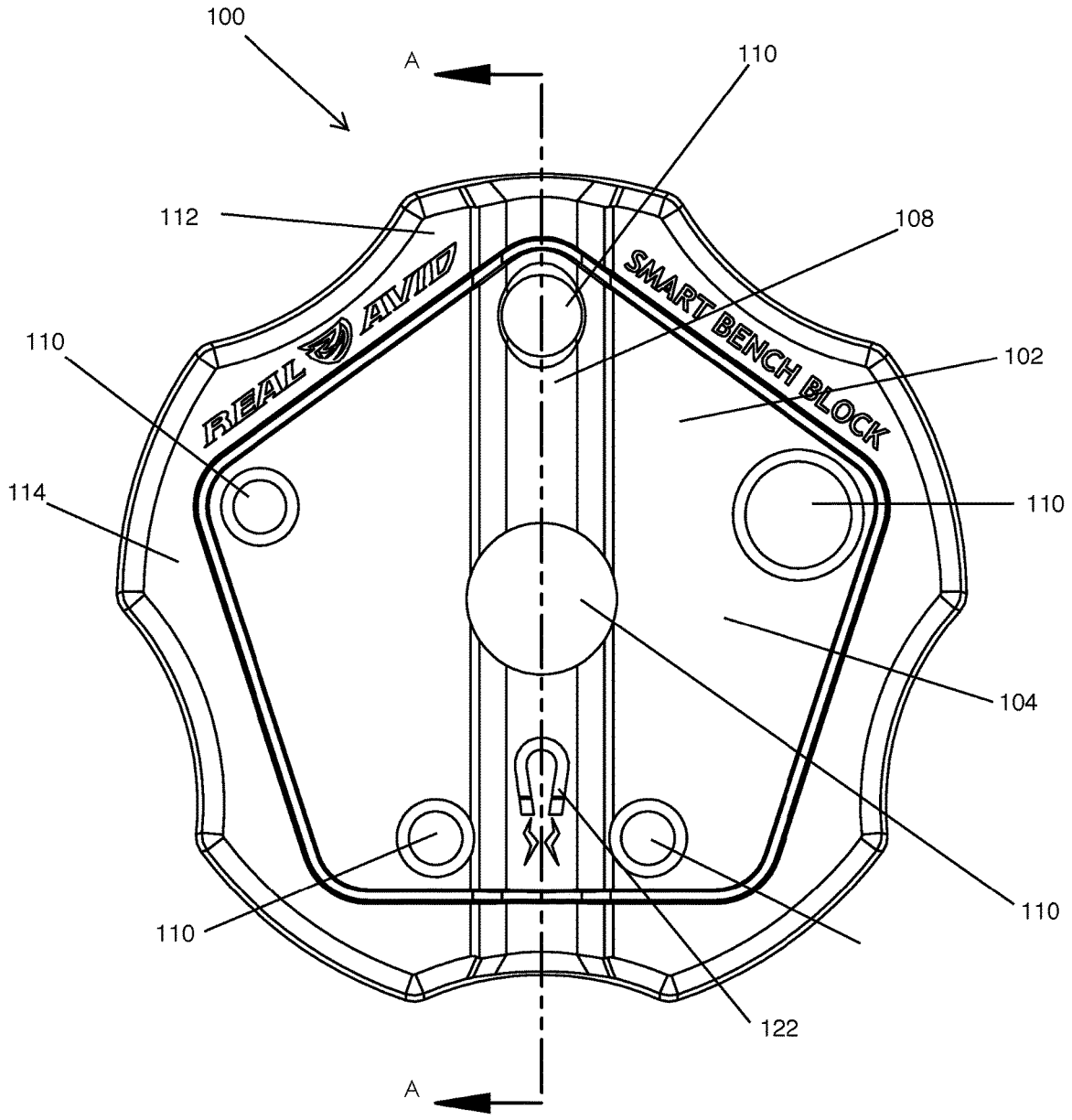
FIG. 1 is a schematic plan view of a top side of a bench block of the present disclosure.

The present disclosure relates to firearm maintenance aids, and more particularly, relates to bench blocks for firearm maintenance. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

The present disclosure describes bench blocks that can aid armorers in firearms maintenance activities by, among other things, firmly supporting firearms during said activities. Bench blocks of the present disclosure can support firearms without marking, marring, or otherwise damaging the finish of the firearms. They can be configured to support removal of pins from firearms by providing openings or holes to receive pins after such removal, and can include features that can help prevent loss of pins after removal. Bench blocks of the present disclosure can be structured to prevent slippage of the block relative to a work surface. Other features can be included, as described elsewhere herein.

Figure 2:
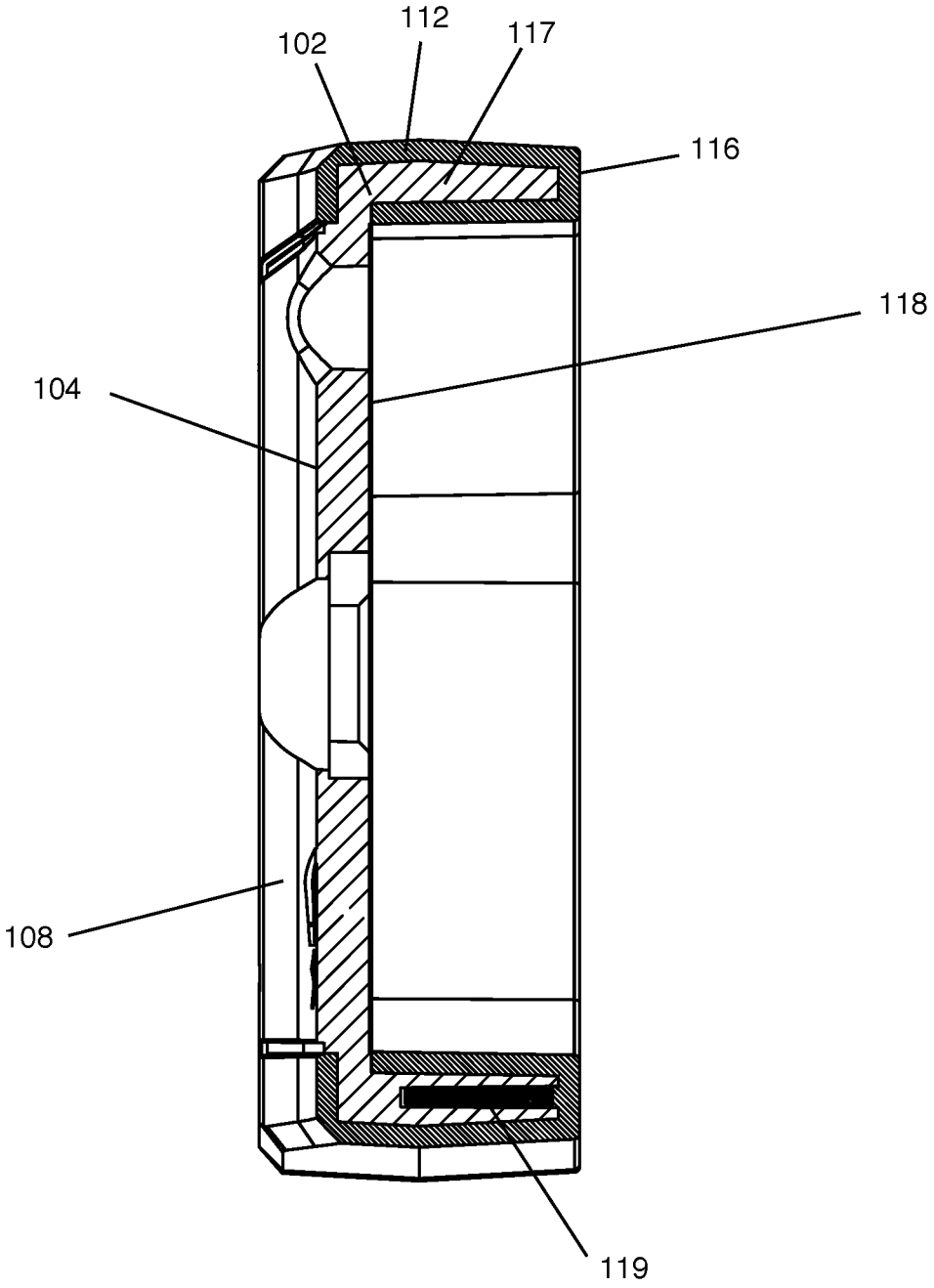
FIG. 2 is a schematic quasi cross-sectional view of the bench block of FIG. 1 along a cut indicated at A-A.
Figure 3:
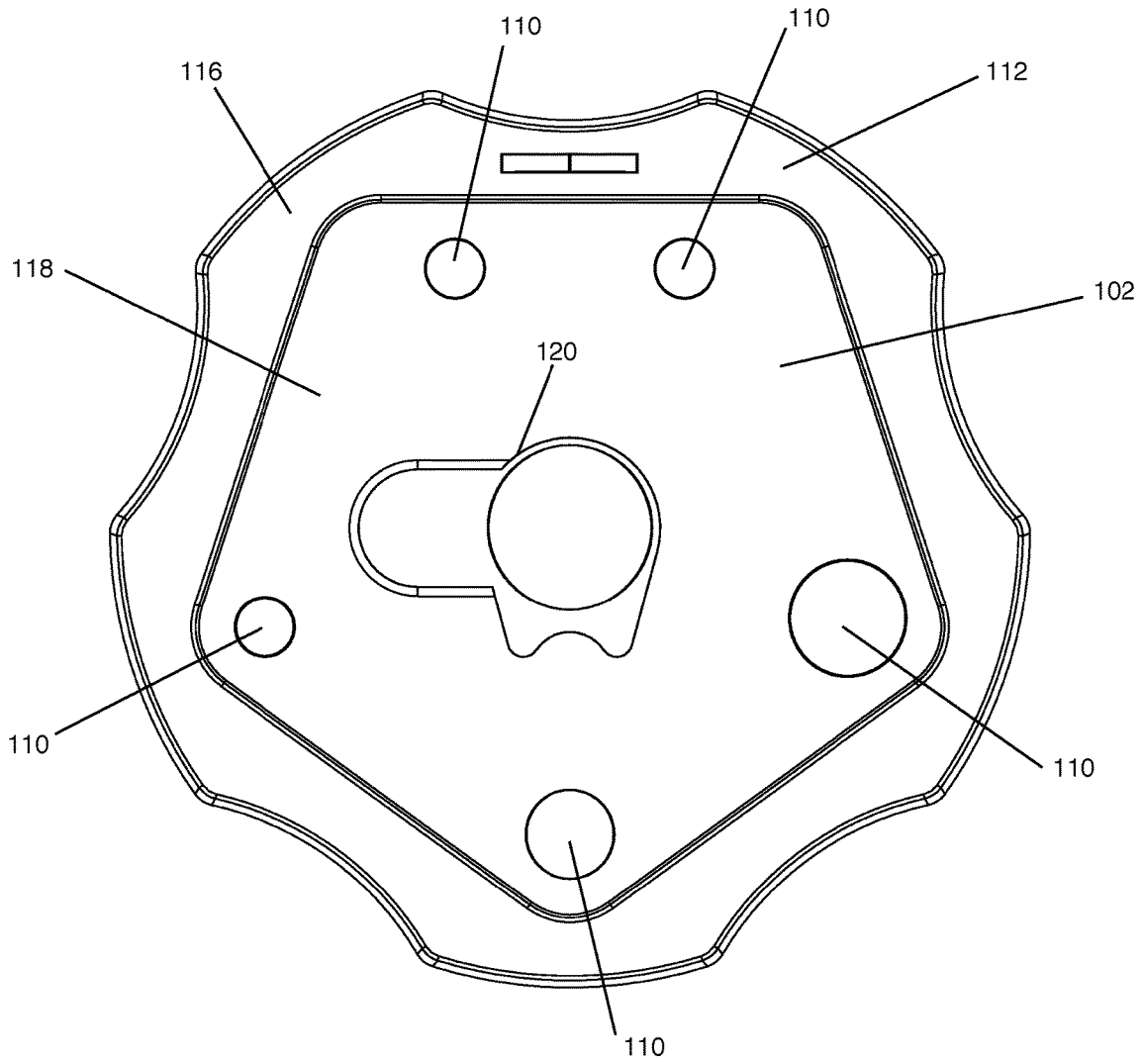
FIG. 3 is a schematic plan view of a bottom side of the bench block of FIG. 1.
Figure 4:
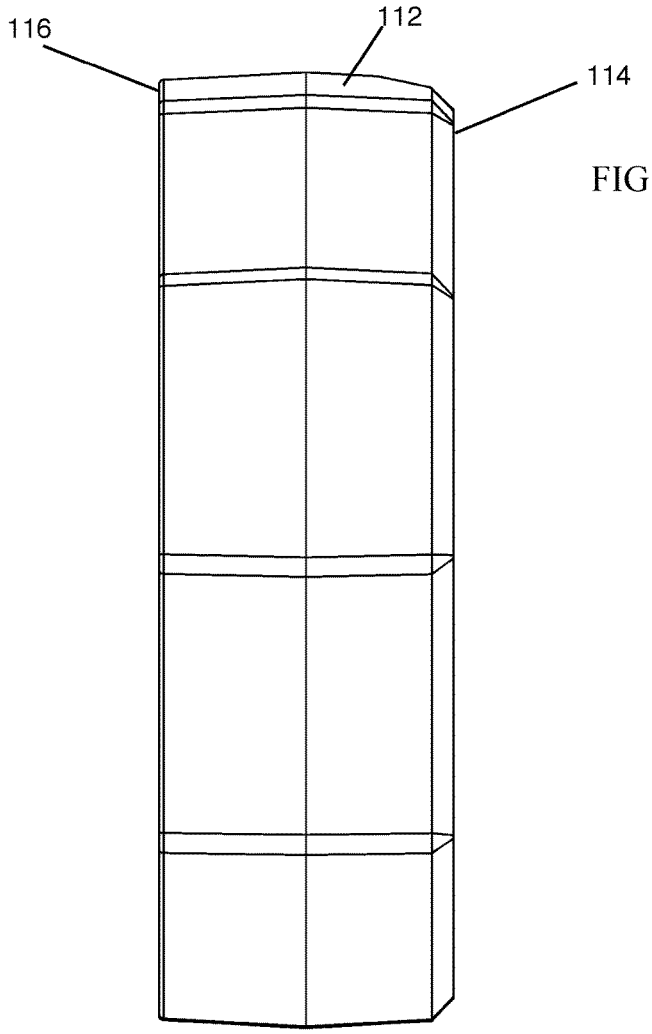
FIG. 4 is a schematic elevation view of a side of the bench block of FIG. 1.
Figure 5:
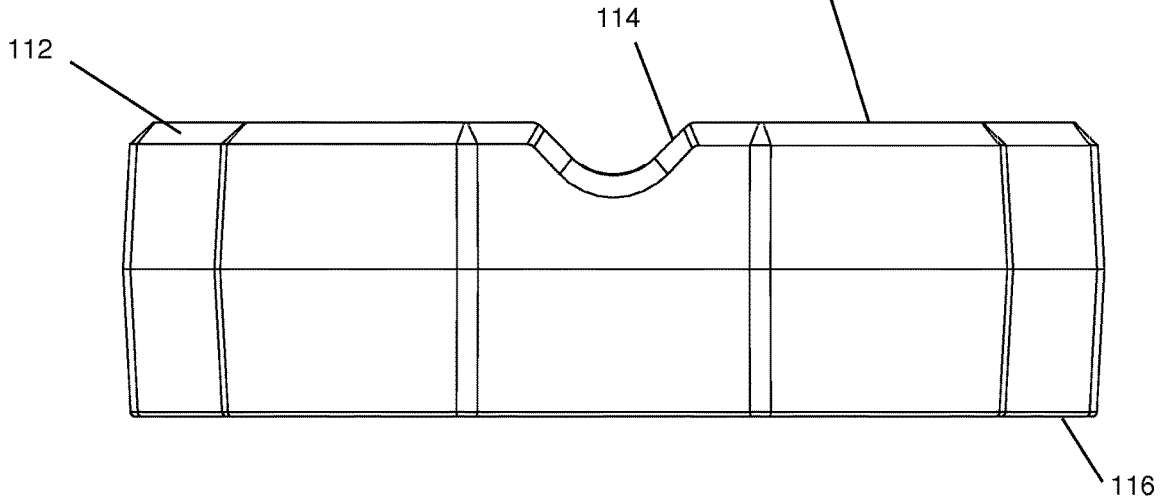
FIG. 5 is a schematic elevation view another side of the bench block of FIG. 1.
Figure 6:
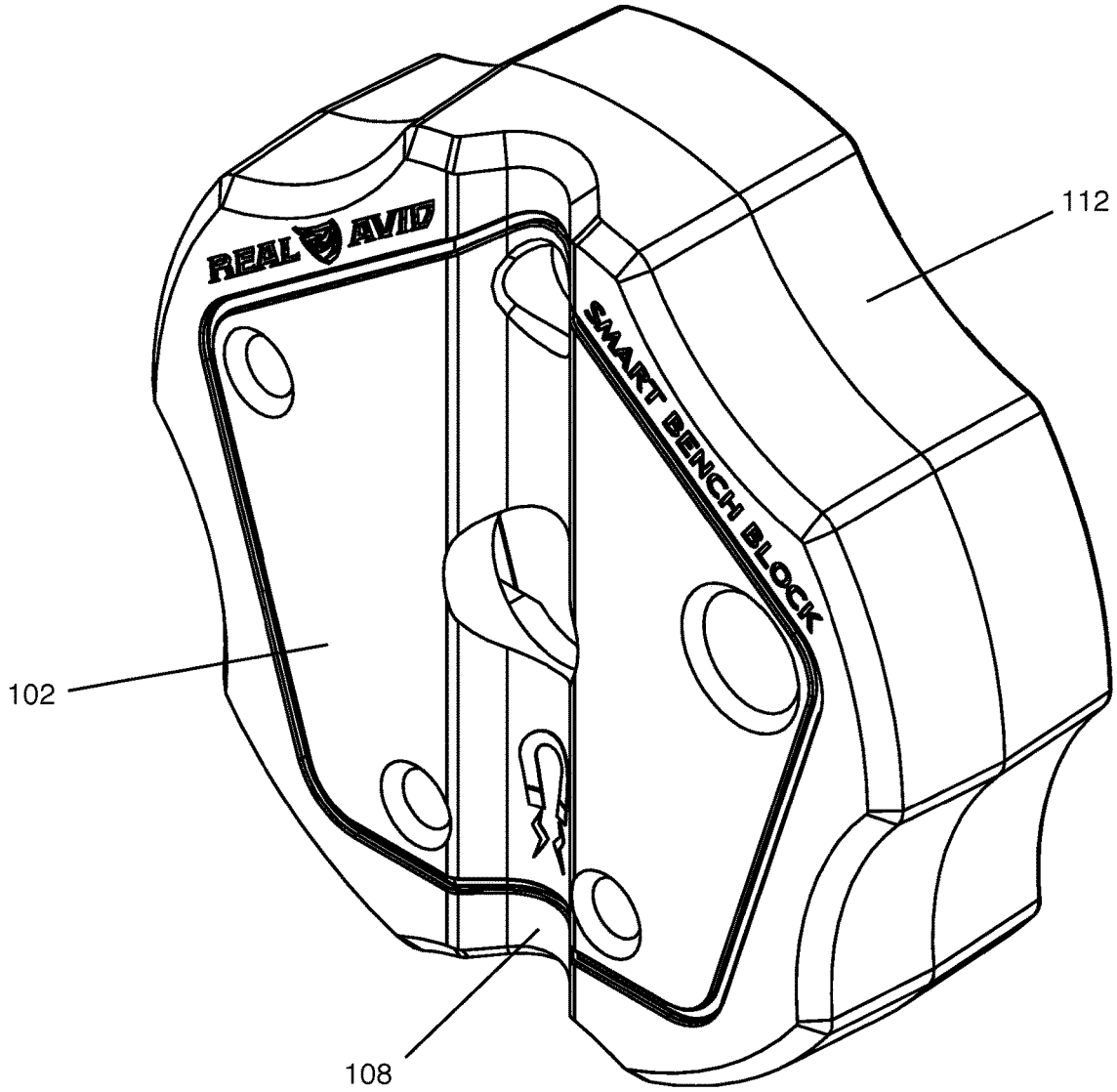
FIG. 6 are schematic perspective views generally from the top side of the bench block of FIG. 1.
Figure 7:
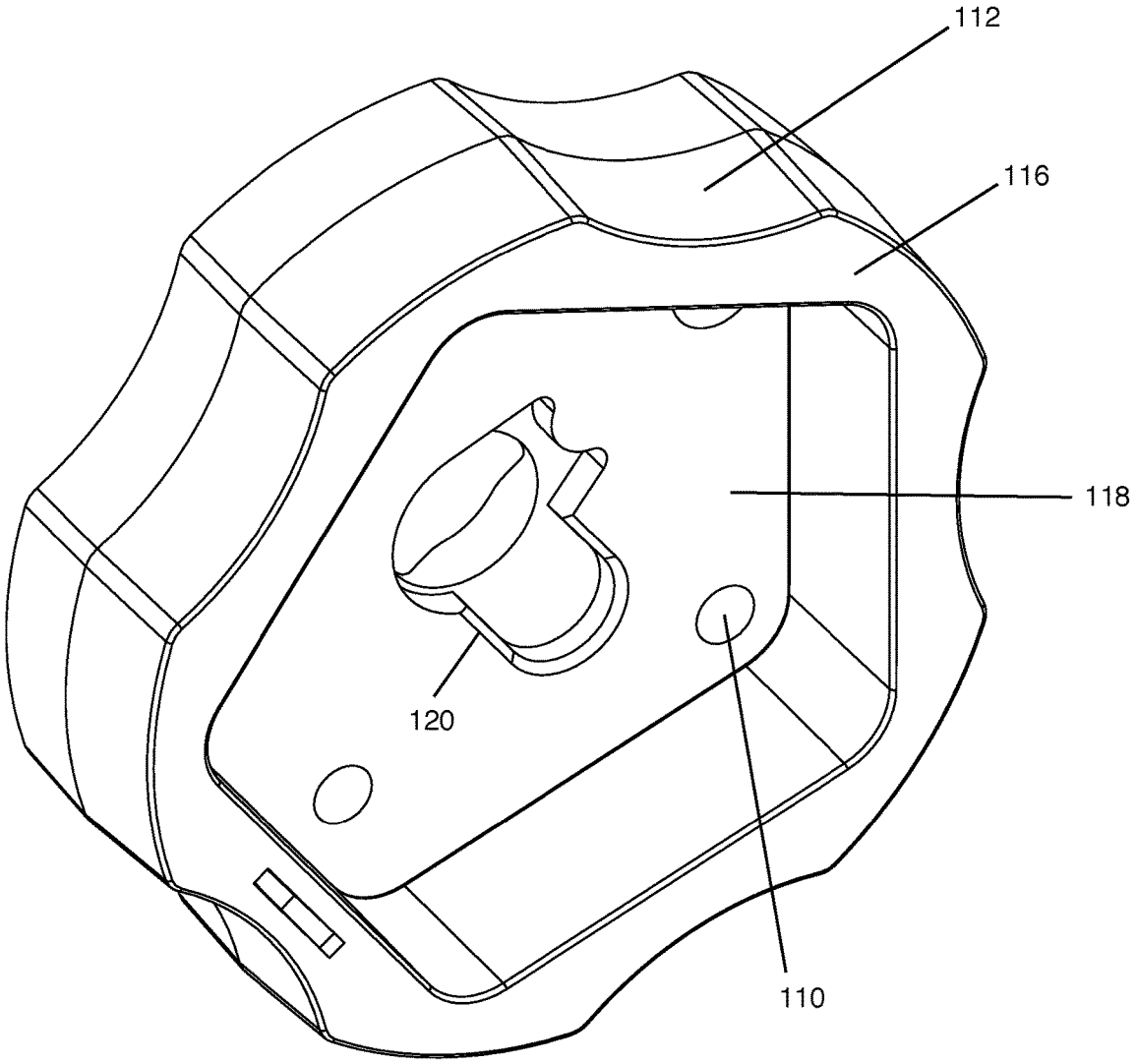
FIG. 7 is a schematic perspective view generally from the bottom side of the bench block of FIG. 1.
Figure 8:
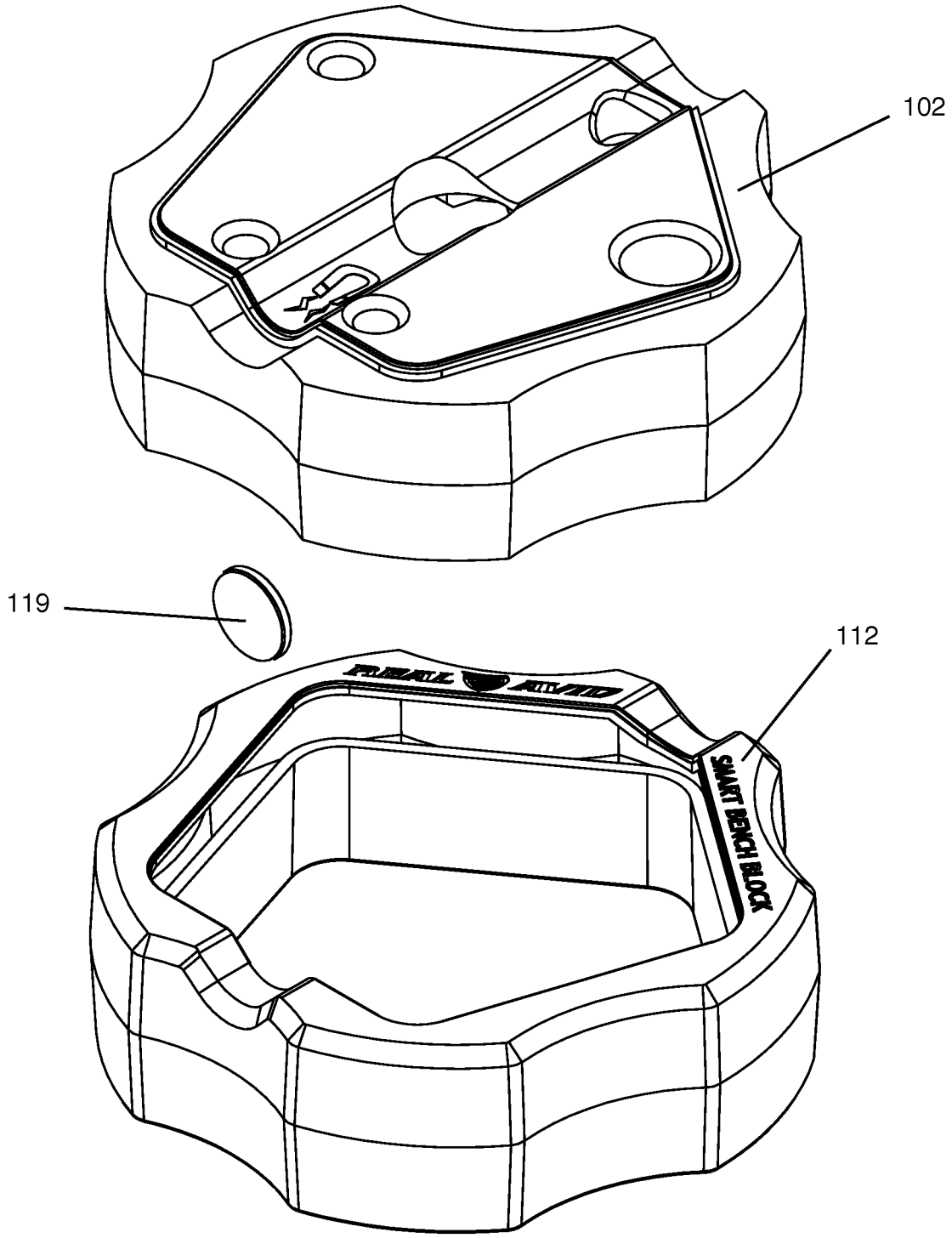
FIG. 8 is an exploded perspective view of the bench block of FIG. 1.

FIG. 1 is a schematic plan view of a top side of a bench block 100 of the present disclosure. FIG. 2 is a schematic cross-sectional view of the bench block of FIG. 1 along a cut indicated at A-A in FIG. 1. FIG. 3 is a schematic plan view of a bottom side of the bench block of FIG. 1. FIG. 4 is a schematic elevation view of a side of the bench block of FIG. 1. FIG. 5 is a schematic elevation view another side of the bench block of FIG. 1. FIG. 6 is a schematic perspective view generally from the top side of the bench block of FIG. 1. FIG. 7 is a schematic perspective view generally from the bottom side of the bench block of FIG. 1. FIG. 8 is an exploded perspective view of the bench block of FIG. 1.

Bench block 100 can include a receiving core 102 that can be formed in any suitable manner of any suitable material. In some embodiments, receiving core 102 is manufactured from an engineering resin such that the core can robustly resist breakage or deformation, yet generally will not mark or mar firearm parts and surfaces with which it comes into contact. A top surface 104 of receiving core 102 can define or include a recess 108 that can be configured to securely receive a firearm or firearm component for performance of maintenance operations. For the purposes of this disclosure, a complete firearm may be referred-to as, and considered, a firearm component, unless the firearm component is explicitly described as being a subcomponent of a firearm. In the embodiment illustrated in FIGS. 1-8, recess 108 can take the form of a trough, channel, or groove that can receive, for example, a barrel or other elongate component of a firearm.

Receiving core 102 can define or include one or more holes 110. One or more of holes 110 can be located at or in recess 108 of core 102. As illustrated, the embodiment of FIGS. 1-8 includes two holes 110 at or in recess 108, but this is not limiting. The embodiment of FIGS. 1-8 as illustrated also includes three holes 110 that are spaced away from recess 108. When a firearm or portion of a firearm is received by recess 108, it can be positioned such that one or more of holes 110 can be aligned with one or more pins of the firearm. Various holes 110 can be sized to accommodate common or standard pin sizes, and need not all be the same size. When a pin is removed from the firearm, for example, by being pressed, punched, or hammered, it can enter an aligned hole 110, which can help with retention of the pin, as discussed further elsewhere herein.

Bench block 100 can include a frame 112 that can be formed in any suitable manner of any suitable material. Frame 112 can substantially surround the perimeter of receiving core 102, as illustrated in the embodiment of FIGS. 1-9. In some examples, a frame does not necessarily entirely surround the perimeter of a receiving core. In some embodiments, frame 112 is manufactured from a natural or synthetic rubber or similar material. A rubber material can exhibit useful properties for frame 112, including tackiness or high-friction between the frame and a surface, such as a table or workbench upon which the bench block may lay, and/or between the frame and a firearm or portion of a firearm in contact with the bench block. Frame 112 can be referred-to as a non-slip frame. In some examples, non-slip frame material can be provided in multiple non-connected pieces located on portions of a core where they can lend high-friction properties. Such multiple pieces of frame material may be referred-to in the context of the present disclosure in the singular as "a frame." In some examples, such as that of bench block 100 of the Figures, a frame can include frame material that is substantially connected or contiguous. In some examples, a frame can consist essentially of frame material that is contiguous.

In some embodiments, and as can be appreciated from the cross-section view of FIG. 2, frame 112 can be overmolded around receiving core 102, and the two parts can be structured and configured such that they substantially cannot be separated non-destructively. In some other cases, receiving core 102 and frame 112 can be manufactured separately, and structured and configured to be fit together after manufacture.

Top edge 114 of frame 112 can be substantially flush with top surface 104 of receiving core 102, and can follow contours in the receiving core, such as the contours of recess 108 at the edge of the core, although correspondence between the top edge of the frame and the top surface of the receiving core are not necessarily required in all embodiments, and/or at all locations along the edge of the core in a single embodiment. In some embodiments, all or a portion of top edge 114 of frame 112 can protrude proud of top surface 104 of receiving core 102. In some embodiments, all or a portion of top edge 114 of frame 112 can lay recessed relative to top surface 104 of receiving core 102. In some embodiments, top edge 114 of frame 112 can be proud, flush, and/or recessed relative to top surface 104 of receiving core 102, in some cases differing at various locations around block 100.

As perhaps best perceived in the cross-sectional view of FIG. 2 and the bottom-side perspective view of FIG. 7, a bottom edge 116 of frame 112 can lay substantially in a plane and can be displaced from bottom surface 118 of receiving core 102. The bottom edge 116 of frame 112 can be just beneath the bottom edge of sidewall(s) 117 of core 102. When substantially-planar bottom edge 116 of frame 112 rests against a surface such as a tabletop or other work surface, friction between the bottom edge of the frame and the surface substantially can prevent slippage of the bench block 100 relative to the surface, when the block is subject to typical forces that it would be expected to be subject to during normal use. When substantially-planar bottom edge 116 of frame 112 rests against a flat surface such as a tabletop or other work surface, the flat surface and the sides of frame 112 can corral or constrain loose small objects, such as pins, that may reside under the bench block. In some examples, the frame may not necessarily be the bottom or lowest part of a bench block at all places around the perimeter of the block. For example, at some places, a sidewall of the core may be the lowest part, and at other places, the frame may be the lowest part. In some cases, the lowest parts of a bench block around the perimeter of a block (whether frame and/or core sidewall) can lay substantially in a plane such that small objects (such as pins) can be corralled. In some cases, the lowest parts of a bench block around the perimeter of a block can deviate from a plane, but may be sufficiently planar such that the deviations from planar are of relatively small magnitude such that small objects (such as pins) can be corralled and not roll, slip, slide, or otherwise move under the sides of the bench block.

In some embodiments, one or more holes 110 of receiving core 102 can be through-holes, such that a pin punched, pressed, or hammered from a firearm and aligned with a through-hole can pass through the through-hole, from top surface 104 of the receiving core to bottom surface 118, and into the space below the bench block, where it can be corralled as described herein. In some embodiments, at least one of holes 110 is not a through-hole, but rather is closed or blind at the bottom, such that a punched pin can remain in the hole after removal from a firearm.

Bench block 100 can include one or more magnets 119, which may not be visible to an end user. Magnet(s) 119 can be integrated with at least one of receiving core 102 and frame 112, for example, by being wholly or partially enclosed by or embedded in at least one of said components. As illustrated in the cross-section view of FIG. 2, in some embodiments one or more magnet(s) 119 can be placed or pressed into a cavity or cavities defined by core 102, then sealed into said cavity/ies by frame 112, which may be overmolded around core 102. In some embodiments, other constructions can be used to integrate magnets into bench blocks, such as embedding into at least one of a core and/or a frame, and/or adhering to at least one of a core and/or a frame.

Magnet(s) 119 can have sufficient magnetic strength to retain pins to bench block 100. In an example use, a pin can be punched from a firearm and drop through a hole 110 to the space beneath bench block 100, where it can be corralled by frame 112. A user can slide bench block on the work surface, with the punched pin still corralled, until a side of frame is brought close enough to the pin for magnet(s) 119 to retain the pin against the inside wall of the frame. The user can pick up bench block 100 and retrieve the pin from its retained position against frame 112. In some embodiments, at least one magnet can be positioned relative to at least one hole 110 such that a pin can be held magnetically in the hole. Bench block 100 can include one or more magnet labels 122 that can indicate that the bench block incorporates one or more magnets. Magnet labels 122 can be located to indicate specific magnet locations and/or can generally indicate the presence of magnets without specificity as to location.

Bench block 100 can include further features to aid in firearm maintenance. The bottom surface 118 of receiving core 102 can define or include barrel bushing wrench 120, which can be a barrel bushing wrench for a 1911 Government Model firearm. Bench block 100 can be structured and configured such that a user can ergonomically grip the bench block and manipulate the bench block to engage the barrel bushing wrench 120 with a firearm.

The ergonomic manipulability of bench block 100 can result in part from the shape of the bench block. Block 100 can take the form of a polygon such as a pentagon (as illustrated), and can have a perimeter substantially shaped as a regular polygon (e.g., pentagon). Receiving core 102 can have a perimeter substantially shaped as a regular polygon (e.g., pentagon). Frame 112 can surround the perimeter of core 102, and in the case of a regular polygonal core, can include multiple sides of essentially the same or similar shape (e.g., the frame can have five sides for a pentagonal core). As illustrated in multiple of FIGS. 1-9, receiving core 102 and frame 112 can define concave gripping recesses corresponding to at least some sides (in some examples, every side) of the regular polygon (e.g., pentagon). Such a polygonal (e.g., pentagonal) shape with gripping recesses can contribute significantly to the ergonomic holdability or gripability of bench block 100.

Bench block 100 of FIGS. 1-8 can include features directed toward maintenance for specific models of firearms, such as a barrel bushing wrench 120 for a 1911 Government Model, and it can include more generic features, such as recess 108 that can accommodate, for example, a variety of barrel sizes and shapes. The present disclosure also envisions bench blocks particularly directed toward maintenance for specific firearm models. Bench block 1000 of FIGS. 10-28, for example, can be structured and configured to provide support for maintenance of AR-15 rifles.

Figure 9:
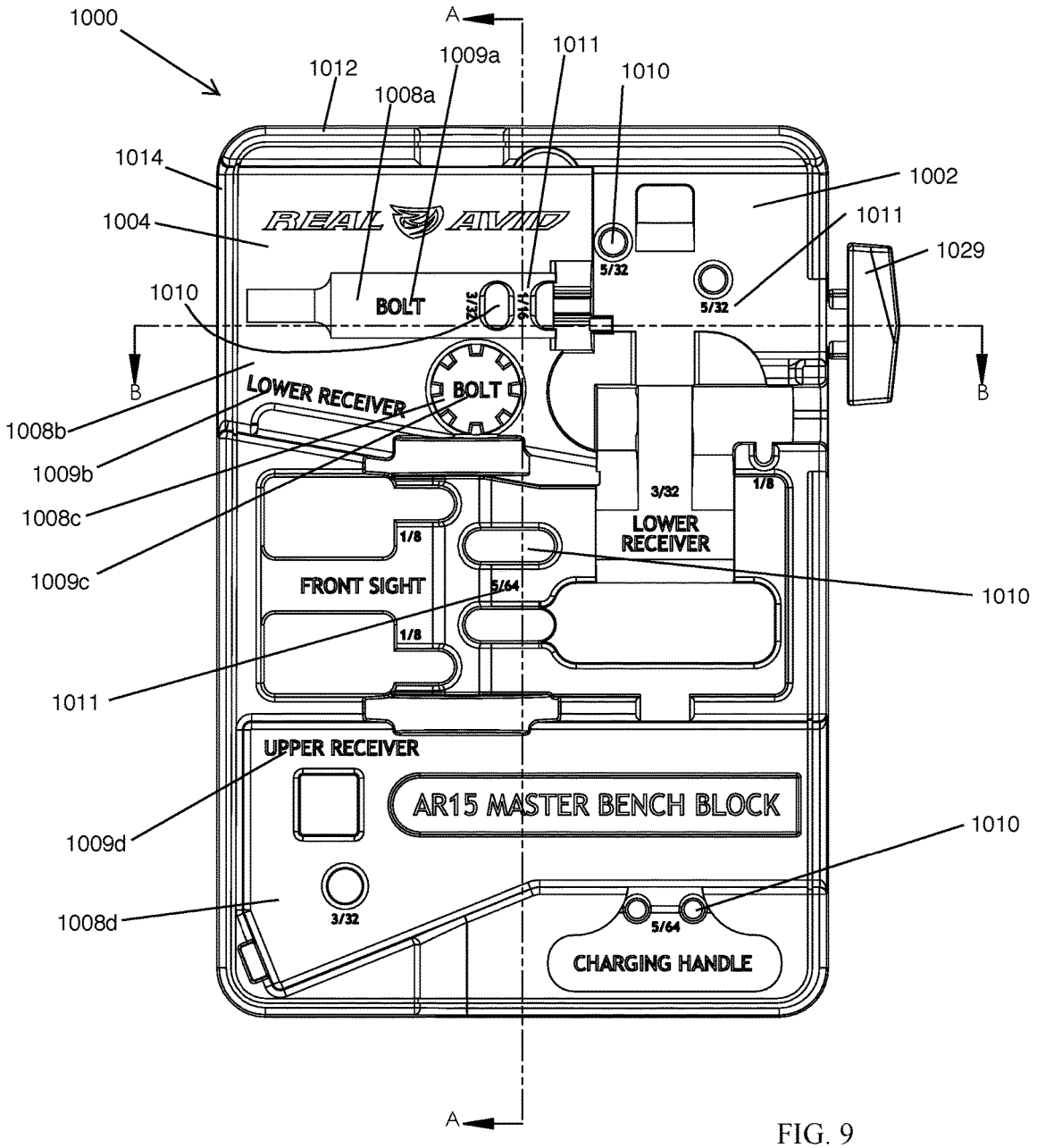
FIG. 9 is a schematic plan view of a top side of an AR-15 bench block of the present disclosure.
Figure 10:
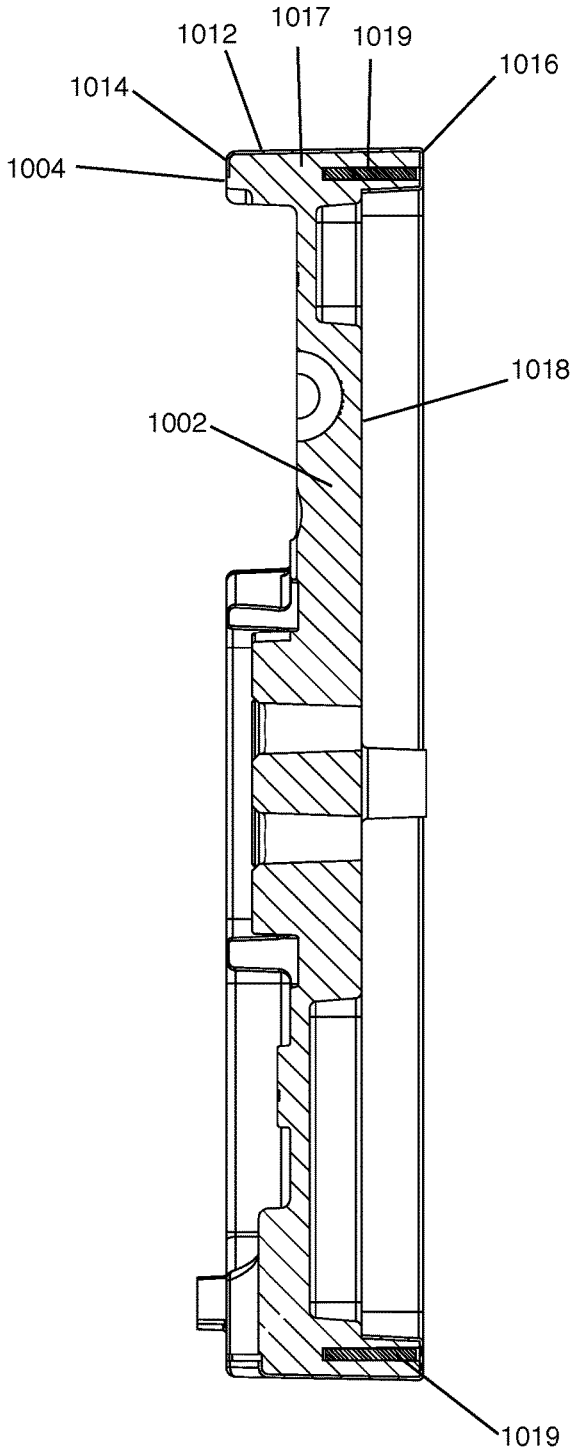
FIG. 10 is a schematic cross-sectional view of the AR-15 bench block of FIG. 9 along a cut indicated at A-A.
Figure 11:
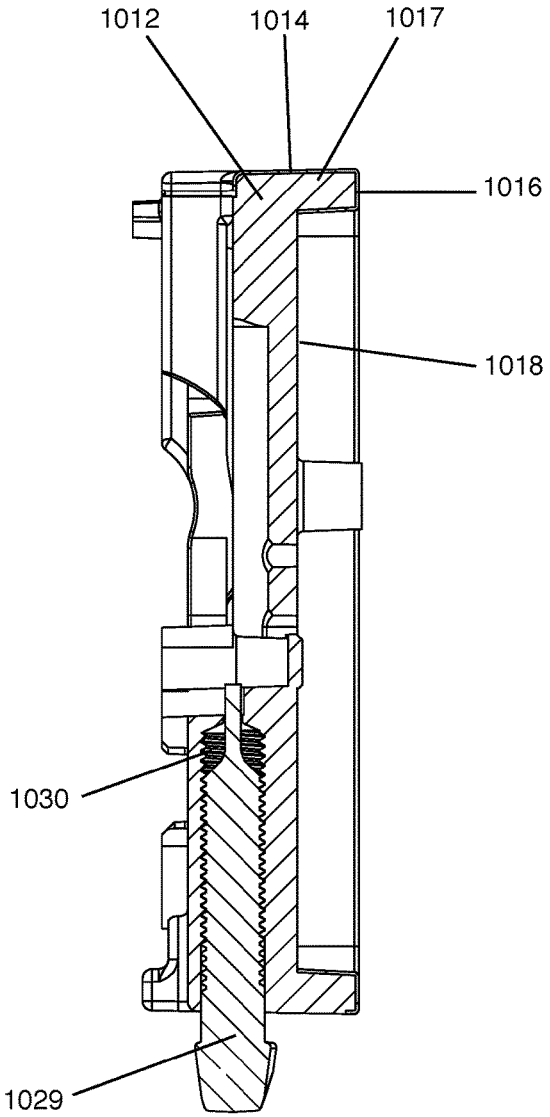
FIG. 11 is a schematic cross-sectional view of the AR-15 bench block of FIG. 9 along a cut indicated at B-B.
Figure 12:
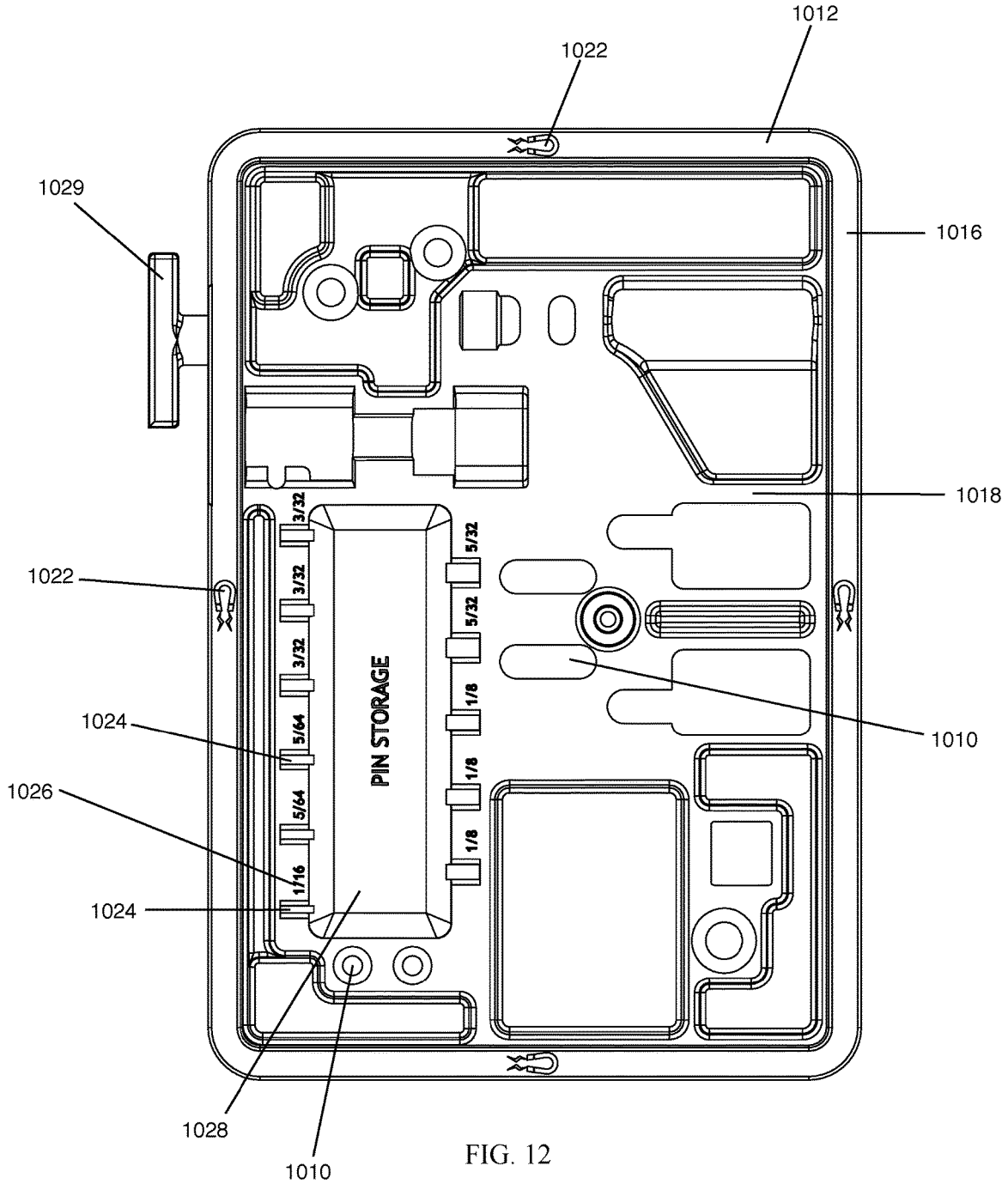
FIG. 12 is a schematic plan view of a bottom side of the bench block of FIG. 9.
Figure 13:
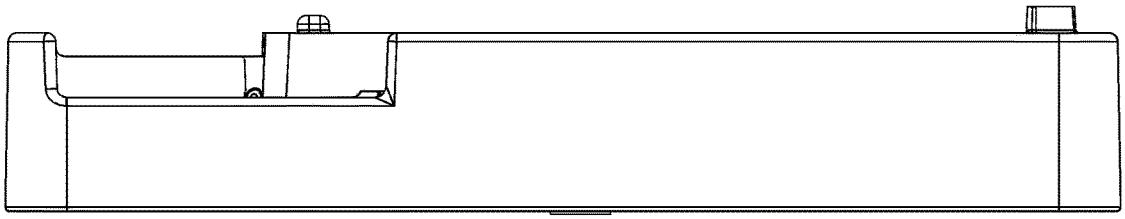
FIGS. 13-16 are schematic elevation views of sides of the bench block of FIG. 9.
Figure 14:
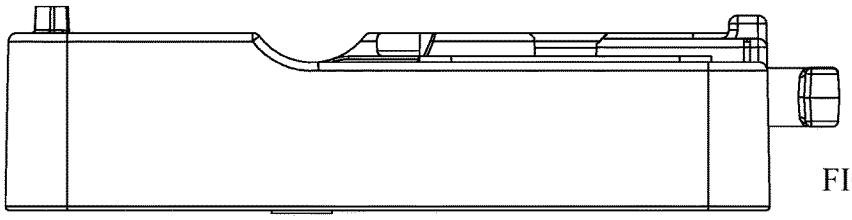
Figure 15:
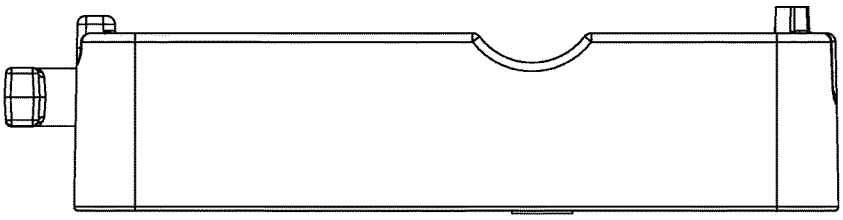
Figure 16:
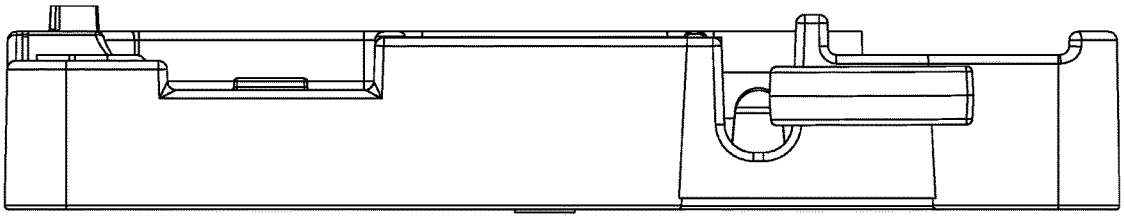
Figure 17:
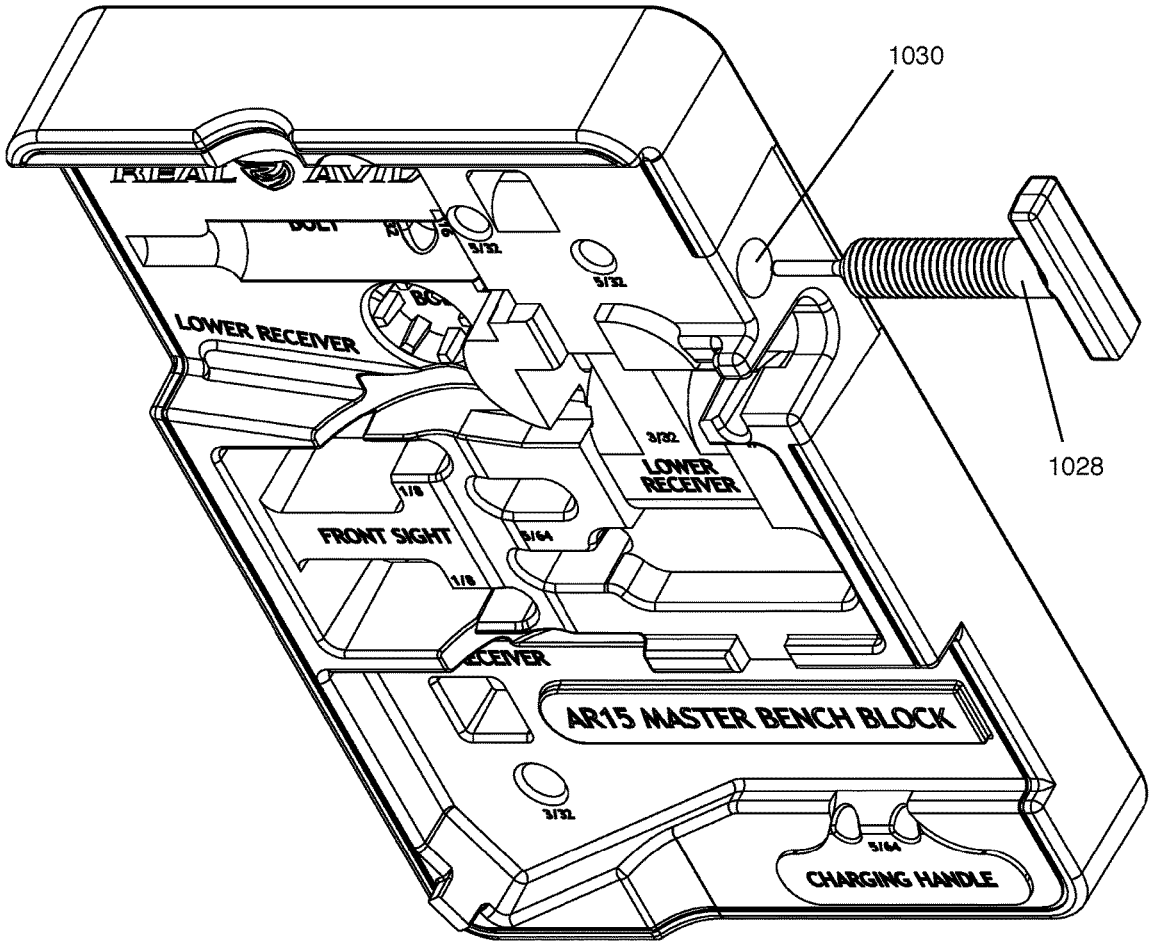
FIG. 17 is a schematic perspective view generally from the top side of the bench block of FIG. 9.
Figure 18:
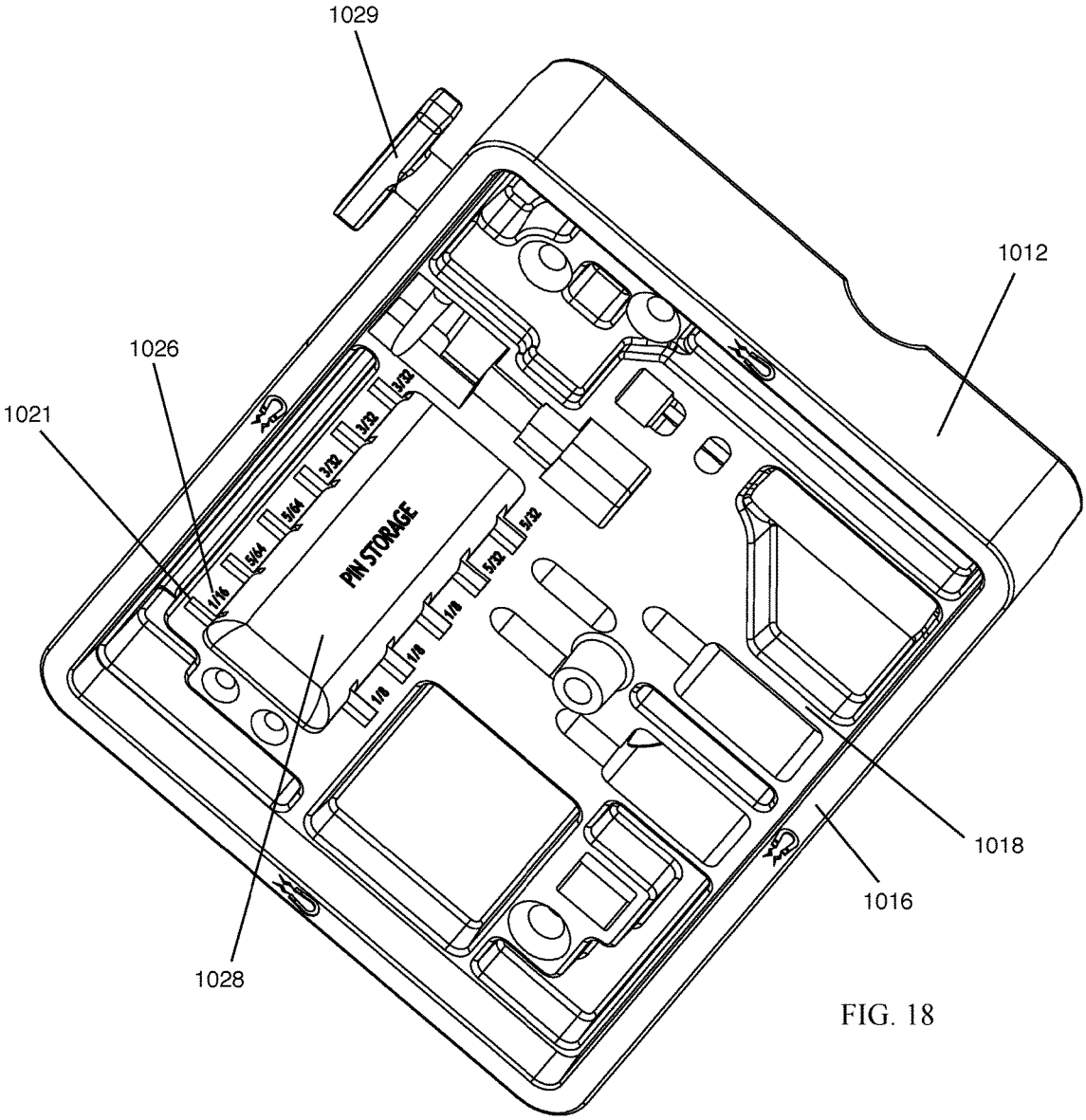
FIG. 18 is a schematic perspective view generally from the bottom side of the bench block of FIG. 9.
Figure 19:
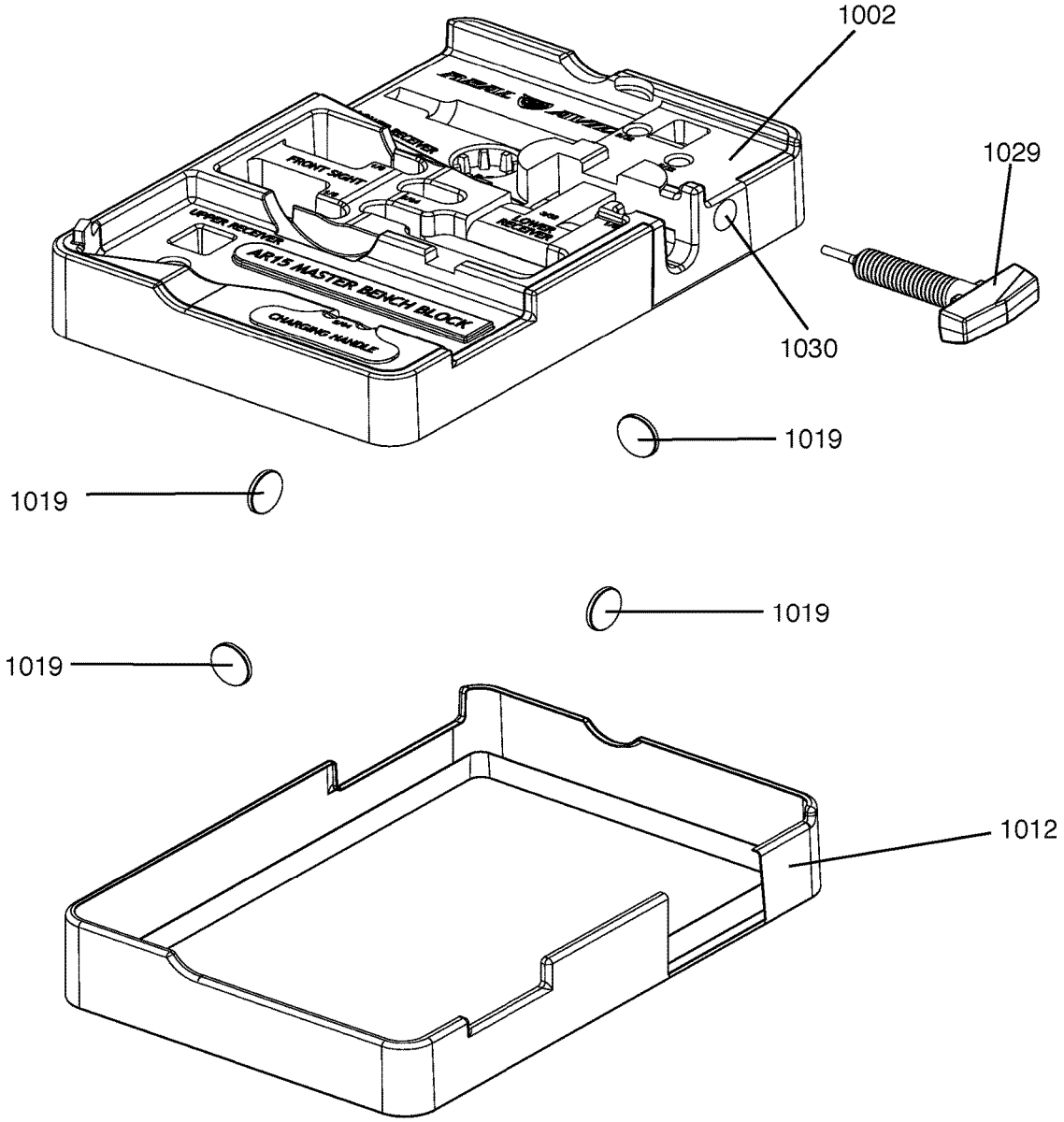
FIG. 19 is an exploded perspective view of the bench block of FIG. 9.

FIG. 9 is a schematic plan view of a top side of an AR-15 bench block 1000 of the present disclosure. FIG. 10 is a schematic cross-sectional view of the bench block of FIG. 10 along a cut indicated at A-A in FIG. 9. FIG. 11 is a schematic cross-sectional view of the bench block of FIG. 10 along a cut indicated at B-B in FIG. 9. FIG. 12 is a schematic plan view of a bottom side of the bench block of FIG. 9. FIGS. 13-16 are schematic elevation views of sides of the bench block of FIG. 9. FIG. 17 is a schematic perspective view generally from the top side of the bench block of FIG. 9. FIG. 18 is a schematic perspective view generally from the bottom side of the bench block of FIG. 9. FIG. 19 is an exploded perspective view of the bench block of FIG. 9.

In several aspects, bench block 1000 can include features that are similar or essentially identical to features of bench block 100. Bench block 1000 can include a receiving core 1002 that can be formed in any suitable manner of any suitable material, such as engineering resin as described in relation to bench block 100. A top surface 1004 of receiving core 1002 can define or include one or more recesses 1008*a-d*, etc., that can be configured to securely receive a firearm or portion of a firearm for performance of maintenance operations.

Figure 25:
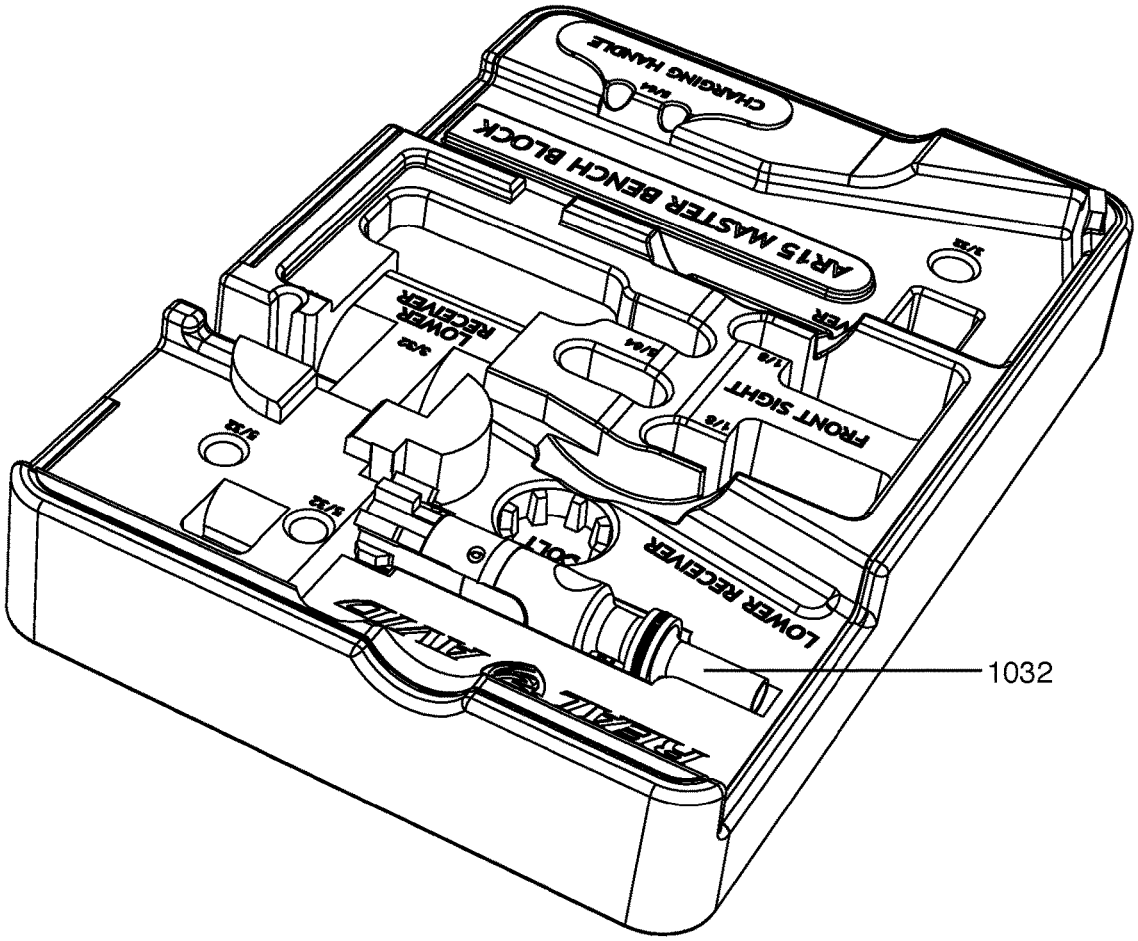
Figure 27:
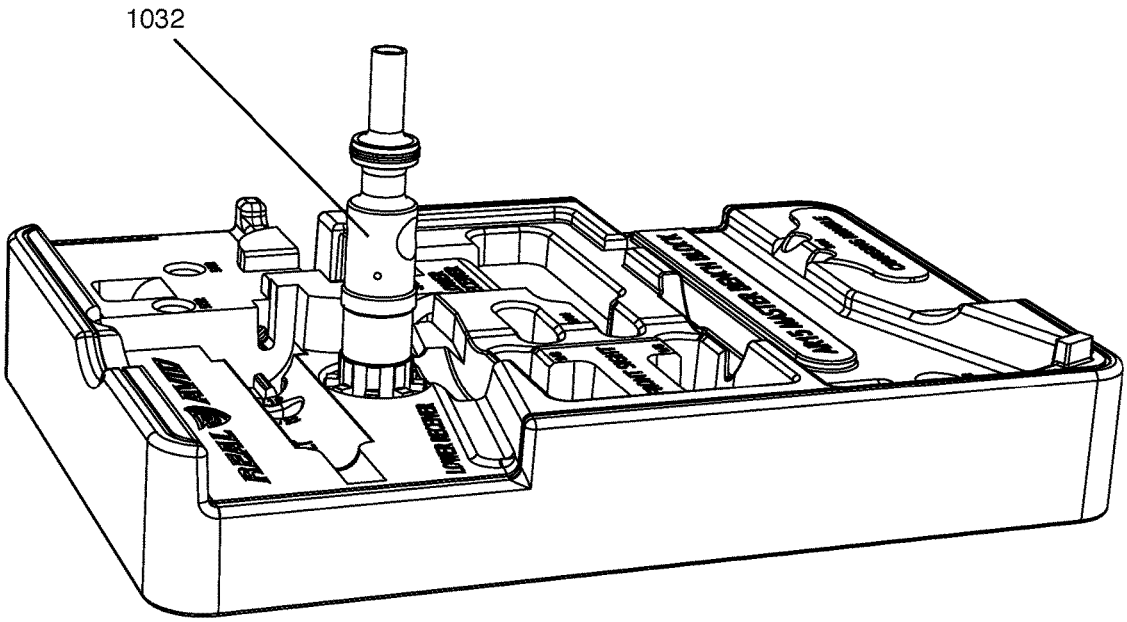
Figure 28:
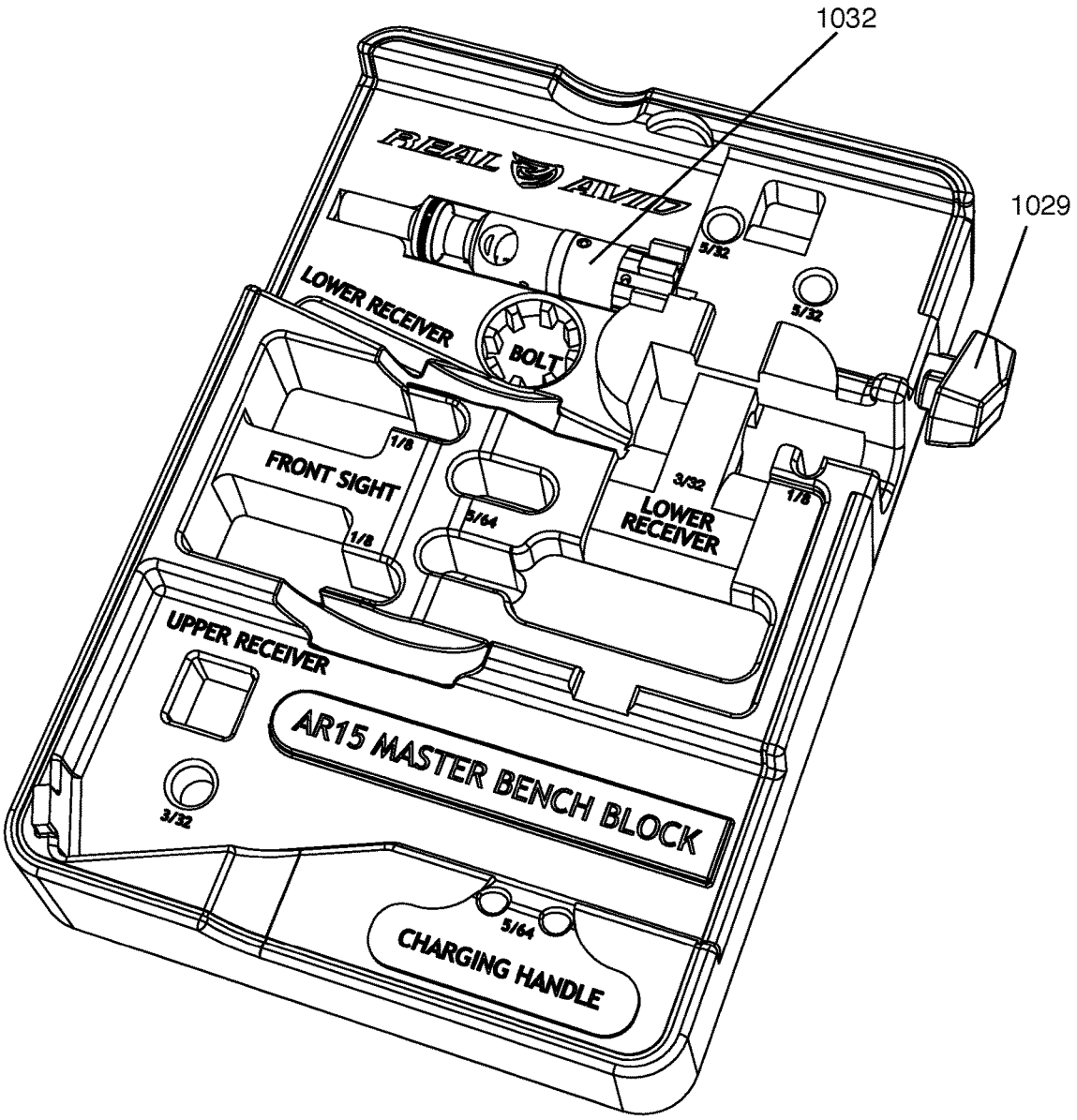

AR-15 bench block 1000 can include a plurality of recesses 1008*a-d*, etc., each of which can be shaped to securely receive an AR-15, sub-component of an AR-15, or portion of an AR-15 or sub-component, etc. As will be understood by the reader, not all such recesses 1008*a-d*, etc., are necessarily labeled with reference numerals and lead lines in the Figures. Receiving core 1002 of AR-15 bench block 1000 can define or include labels 1009*a-d*, etc., corresponding to recesses 1008*a-d*, etc., in order to assist a user in recognizing what part or portion of the firearm corresponds to a particular recess, although such labels are not necessarily required to be provided in a one-to-one correspondence with the recesses, or to be provided at all. Labels 1009*a-d*, etc., can be provided in any suitable manner, such as printing, etching, surface relief, etc. In some cases, multiple recesses can be provided to receive the same firearm part, but in different orientations. For example, recesses 1008*a* and 1008*c* are both configured to receive an AR-15 bolt 1032, but in lengthwise and end-on orientations, as illustrated in FIGS. 25 & 28, and FIG. 27, respectively.

Receiving core 1002 can define or include one or more holes 1010, similar to receiving core 102. Some of holes 1010 can be located at or in some of recesses 1008*a-d*, etc., and some can be located away from any recess. As will be understood by the reader, not all such holes 1010 are labeled with reference numerals and lead lines in the Figures. When a firearm or portion of a firearm is received by one of recesses 1008*a-d*, etc., it can be positioned such that one or more of holes 1010 can be aligned with one or more pins of the firearm. Various holes 1010 can be sized to accommodate common or standard pin sizes at corresponding locations of the firearm, and need not all be the same size. Pin sizes can be labeled on receiving core 1002, such as at labels 1011 (not all pin size labels are labeled with reference numerals and lead lines in the Figures), which can aid a user in identifying, remembering, or learning pin sizes associated with specific locations/functions of the firearm. When a pin is removed from the firearm, for example, by being pressed, punched, or hammered, it can enter an aligned hole 1010, where it can pass from the top surface 1004 of receiving core 1002 to the bottom surface 1018, if the hole is a through-hole, or be retained in the hole if the hole is not a through-hole.

Bench block 1000 can include a frame 1012 that can be formed in any suitable manner of any suitable material. Frame 1012 can substantially surround the perimeter of receiving core 1002. In some examples, a frame does not necessarily entirely surround the perimeter of a receiving core. In some embodiments, frame 1012 is manufactured from a natural or synthetic rubber or similar material, which can provide the characteristic of tackiness or high-friction between the frame and a surface, such as a table or workbench upon which the bench block may lay, and/or between the frame and a firearm or portion of a firearm in contact with the bench block. Frame 1012 can be referred-to as a non-slip frame. Similarly, as described in relation to bench block 100, in some examples, non-slip frame material can be provided in multiple non-connected pieces located on portions of a core where they can lend high-friction properties. In some examples, a frame can include frame material that is substantially connected or contiguous. In some examples, a frame can consist essentially of frame material that is contiguous.

In some embodiments, and as can be appreciated from the cross-section views of FIGS. 10 and 11, frame 1012 can be overmolded around receiving core 1002, and the two parts can be structured and configured such that they substantially cannot be separated non-destructively. In some other cases, receiving core 1002 and frame 1012 can be manufactured separately, and structured and configured to be fit together after manufacture.

Top edge 1014 of frame 1012 can be substantially flush with top surface 1004 of receiving core 1002, and can follow contours in the receiving core, such as the contours of any of recesses 1008*a-d*, etc., that are at the edge of the core, although correspondence between the top edge of the frame and the top side of the receiving core are not necessarily required in all embodiments, and/or at all locations along the edge of the core in a single embodiment. Similarly, as described in relation to block 100, in some embodiments top edge 1014 of frame 1012 can be proud, flush, and/or recessed relative to top surface 1004 of receiving core 1002, in some cases differing at various locations around block 1000.

As perhaps best perceived in the cross-sectional views of FIGS. 10 and 11 and the bottom-side perspective view of FIG. 18, bottom edge 1016 of frame 1012 can lay substantially in a plane and can be displaced from bottom surface 1018 of receiving core 1002. The bottom edge 1016 of frame 1012 can be just beneath the bottom edge of sidewall(s) 1017 of core 1002. When substantially-planar bottom edge 1016 of frame 1012 rests against a surface such as a tabletop or other work surface, friction between the bottom edge of the frame and the surface substantially can prevent slippage of the bench block 1000 relative to the surface, when the block is subject to typical forces that it would be expected to be subject to during normal use. When substantially-planar bottom edge 1016 of frame 1012 rests against a flat surface such as a tabletop or other work surface, the flat surface and the sides of frame 1012 can corral or constrain loose small objects, such as pins, that may reside under the bench block. Similarly, as described in relation to bench block 100, in some examples, the frame may not necessarily be the bottom or lowest part of a bench block at all places around the perimeter of the block. In some cases, the lowest parts of a bench block around the perimeter of a block (whether frame and/or core sidewall) can lay substantially in a plane such that small objects (such as pins) can be corralled. In some cases, the lowest parts of a bench block around the perimeter of a block can deviate from a plane, but may be sufficiently planar such that the deviations from planar are of relatively small magnitude such that small objects (such as pins) can be corralled and not roll, slip, slide, or otherwise move under the sides of the bench block.

Bench block 1000 can include one or more magnets 1019, which may not be visible to an end user. Magnets 1019 can be integrated with at least one of receiving core 1002 and frame 1012, for example, by being wholly or partially embedded in at least one of said components. As illustrated in the cross-section view of FIG. 10, in some embodiments magnets 1019 can be placed or pressed into cavities defined by core 1002, then sealed into said cavities by frame 1012, which may be overmolded around core 1002.

Magnet 1019 can have a sufficient magnetic strength to retain pins to bench block 1000, such as pins punched from a firearm and dropped through one of holes 1010 to the space beneath bench block 1000. In some embodiments, at least one magnet can be positioned relative to at least one hole 1010 such that a pin can be held magnetically in the hole. Bench block 1000 can include one or more magnet labels 1022 that can indicate that the bench block incorporates one or more magnets. Magnet labels 1022 can be located to indicate specific magnet locations and/or can generally indicate the presence of magnets without specificity as to location.

Bench block 1000 can include pin storage features. As illustrated in, for example FIGS. 12 and 18, receiving core 1002 can include a pin storage area on its bottom surface 1018, although this is not limiting and in other embodiments, pin storage could be provided in other locations, such as on a top side of the receiving core, or as part of frame 1012. Bench block 1000 can include pin storage slots 1024, which can have associated pin size labels 1026. The pin storage area can include a recess 1028 that can provide clearance for a user's fingertip(s) when manipulating pins. In some cases, pins can be retained in pin storage slots 1024 via friction fit. Pin storage slots 1024 can be slightly undersized to enable pin retention. In some cases, magnets may be employed to retain pins in pin storage slots 1024, and/or more generally in the pin storage area.

Figure 20:
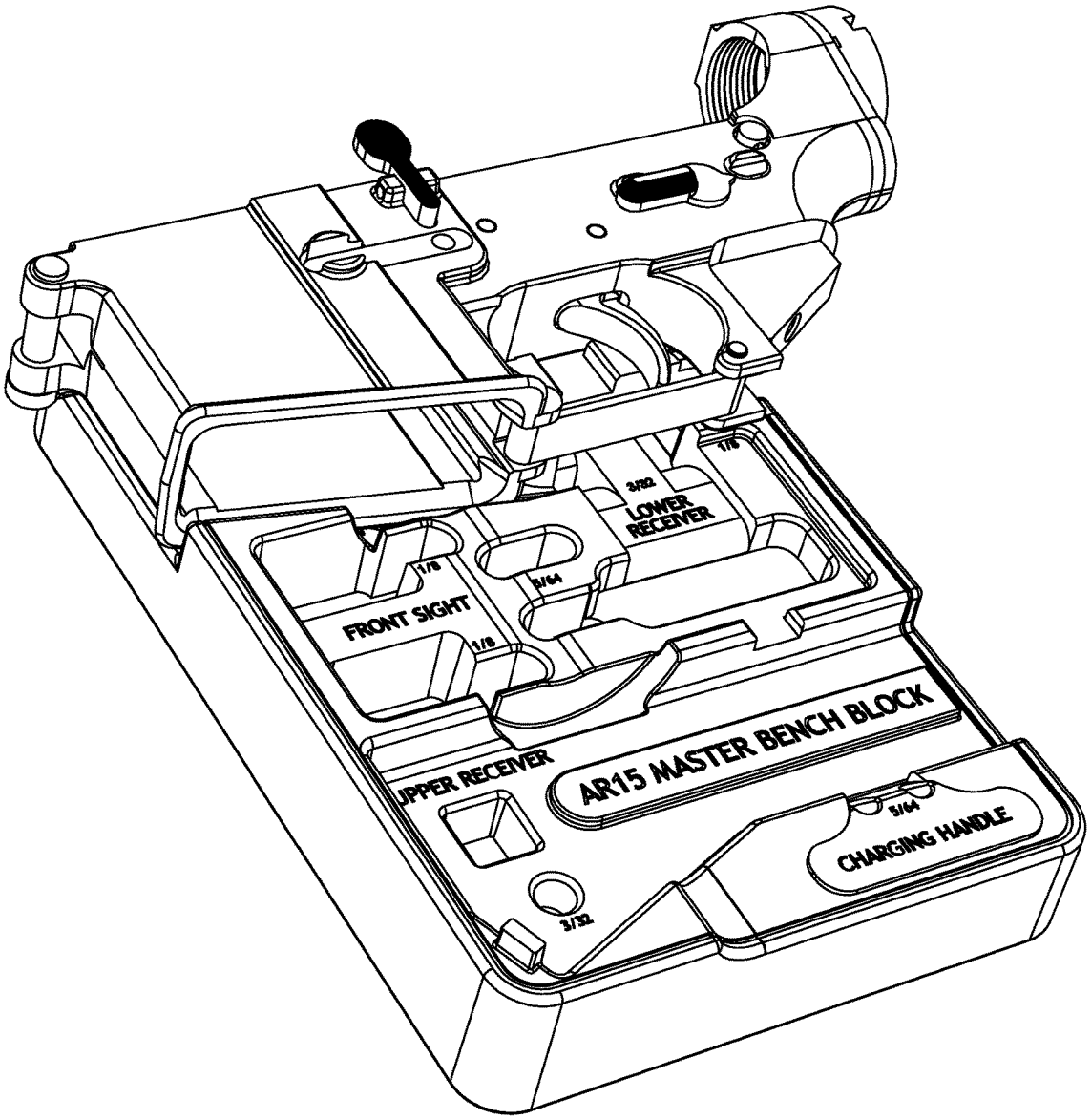
FIG. 20-28 are schematic perspective illustrations of the bench block of FIG. 9 with various AR-15 components received by the bench block for various maintenance operations.
Figure 21:
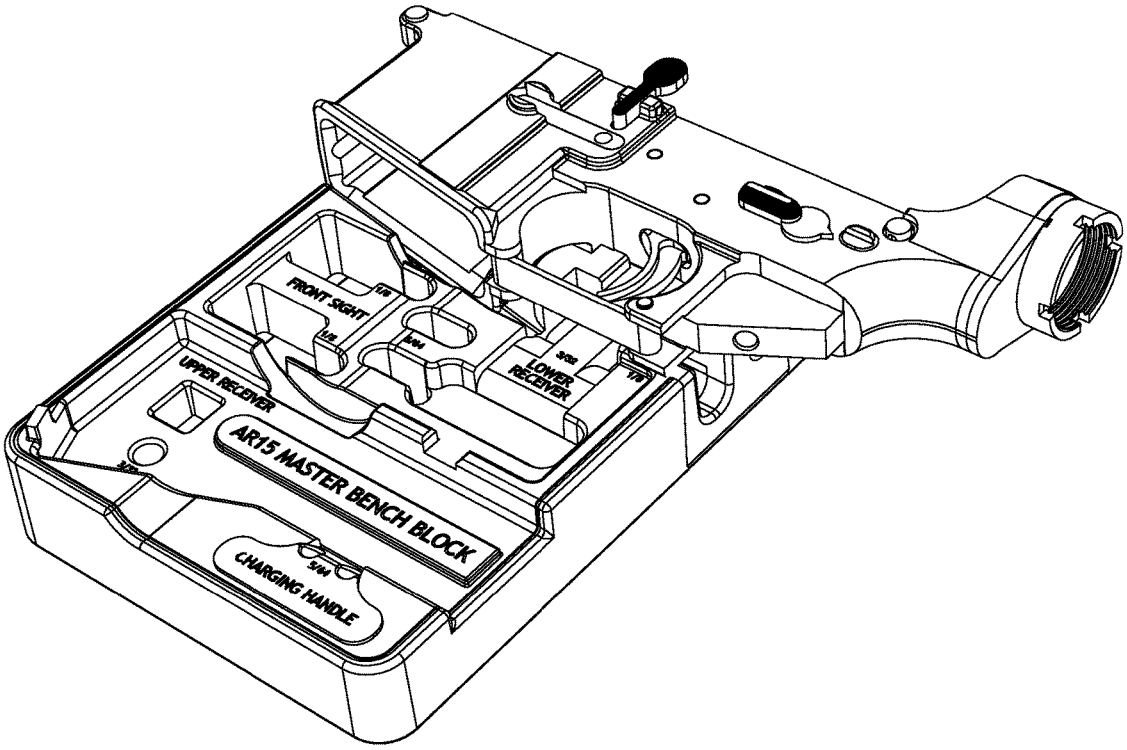
Figure 22:
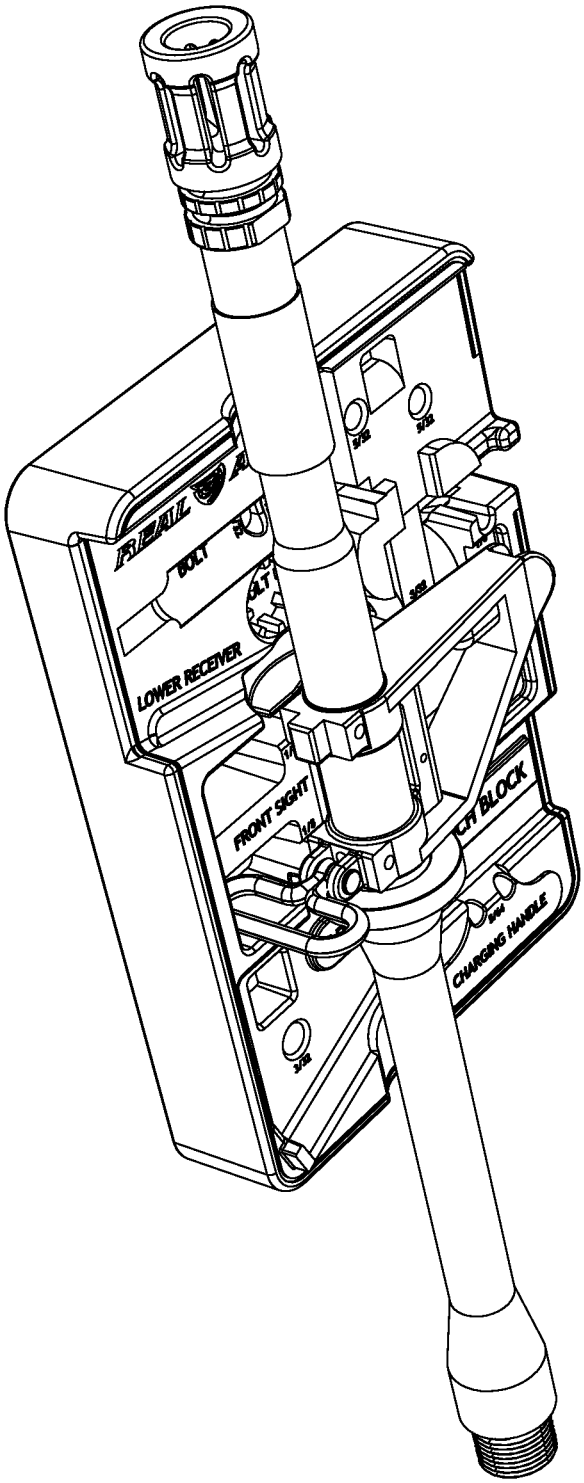
Figure 23:
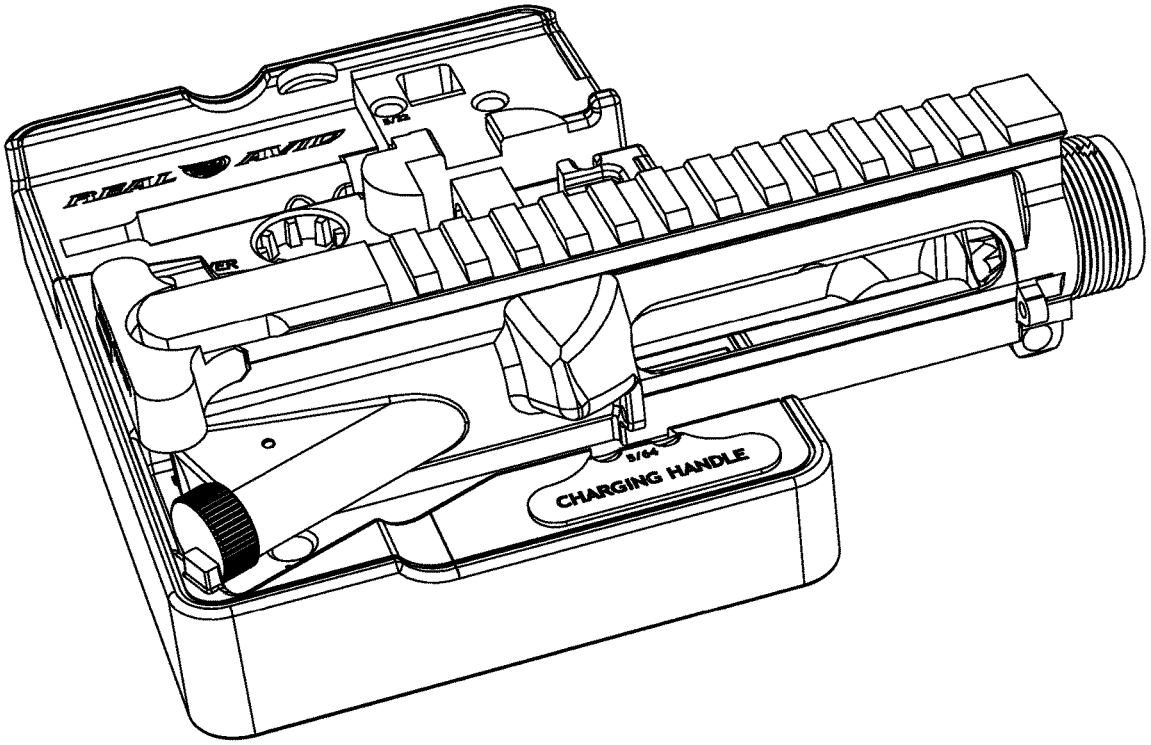
Figure 24:
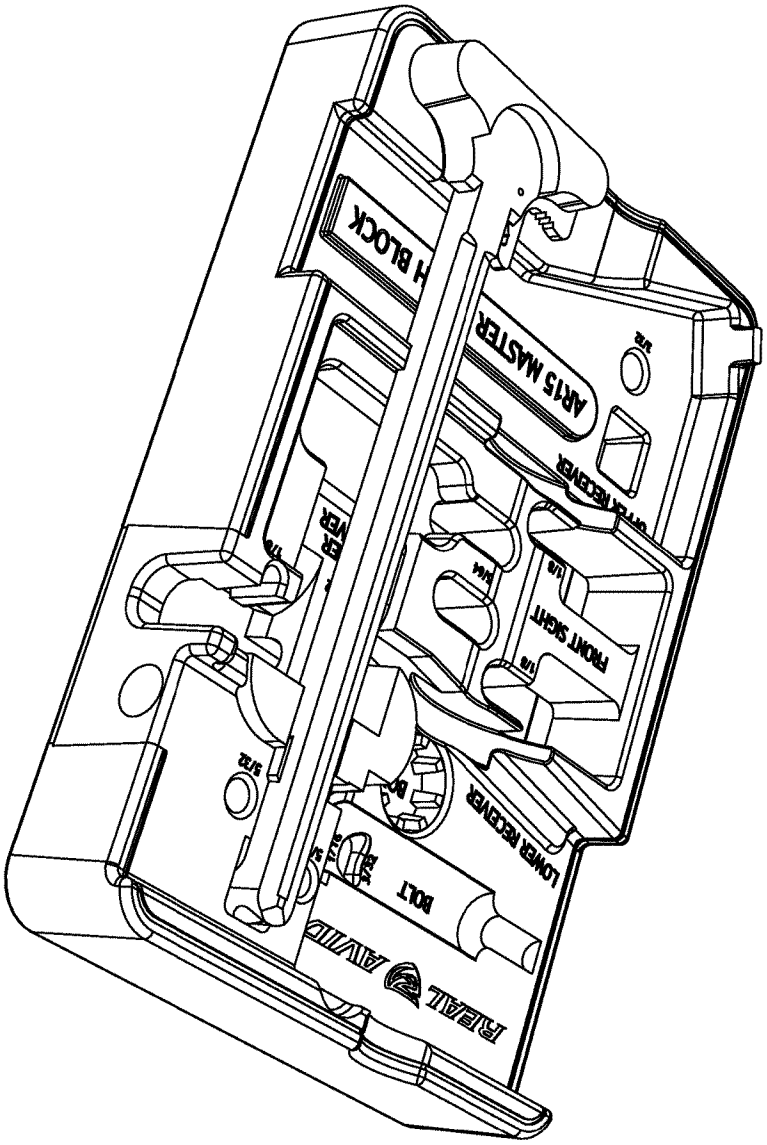
Figure 26:
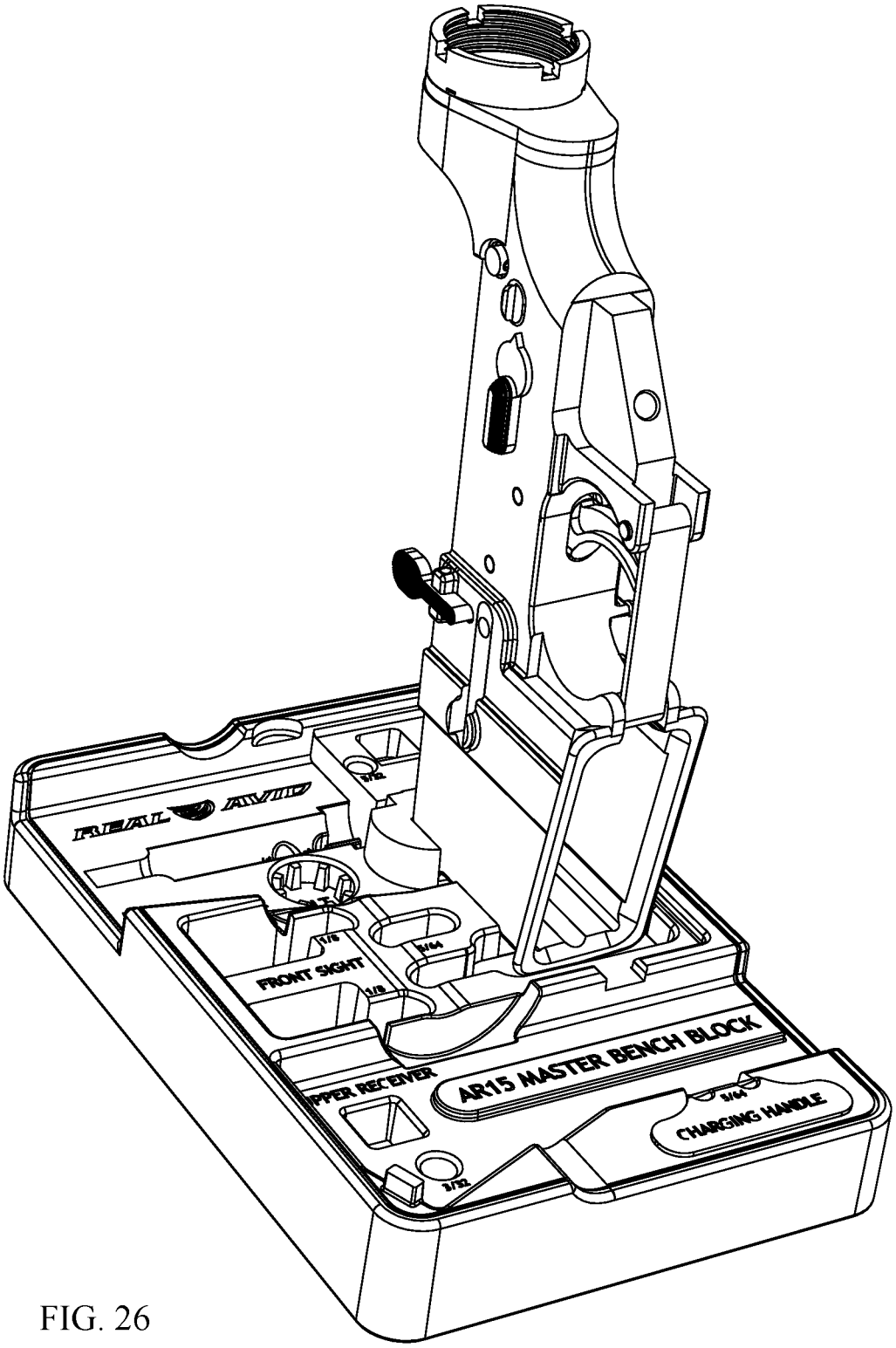

AR-15 bench block 1000 can advantageously assist a user in a wide variety of maintenance operations on AR-15 rifles and components thereof. FIGS. 20-28 are schematic perspective illustrations of bench block 1000 with various AR-15 components received by the bench block for various maintenance operations. Without limitation, FIG. 20 depicts a configuration for trigger assembly maintenance; FIG. 21 depicts a configuration for trigger guard maintenance; FIG. 22 depicts a configuration for gas block maintenance; FIG. 23 depicts a configuration for forward assist maintenance; FIG. 24 depicts a configuration for charging handle maintenance; FIG. 25 depicts a configuration for bolt extractor maintenance; FIG. 26 depicts a configuration for bolt catch maintenance; FIG. 27 depicts a configuration for bolt gas ring installation; and FIG. 28 depicts a configuration for bolt ejector maintenance.

AR-15 bench block 1000 can include a threaded T-handled tool 1029 that can be structured and configured to cooperate with a complementary tapped receiving opening 1030 defined by core 1002. When an AR-15 bolt 1032 is received by the receiving core 1002, for example as illustrated in FIG. 28, T-handled tool 1029 can be advanced into opening 1030 to apply tension to the bolt ejector of the bolt 1032. Once the bolt ejector is under tension, the bolt ejector retaining pin can easily be removed or installed. This operation is illustrated in part in FIG. 28. The cross-sectional view of FIG. 11 also may aid appreciation of this feature.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A firearm bench block, comprising:

a receiving core comprising a first material and having a top side and a bottom side:

the receiving core defining at least a first recess on the top side configured to securely receive a firearm component for performance of a maintenance operation; and the receiving core further defining at least a first through-hole positioned so that when the firearm component is securely received by the first recess of the receiving core, the first through-hole is aligned with a corresponding first pin of the firearm component, such that when the first pin is punched from the firearm component, the first pin can pass through the first through-hole from the top side to the bottom side of the receiving core; and a non-slip frame comprising a second material and structured to substantially surround a perimeter of the receiving core, the non-slip frame further having a bottom edge that is displaced from the bottom side of the receiving core such that when the bottom edge of the non-slip frame rests against a flat surface, the non-slip frame retains the first pin to a space bounded at least by the non-slip frame and the flat surface, when the first pin is present in said space.

2. The block of claim 1, further comprising at least one magnet integrated with at least one of the receiving core and the non-slip frame, the at least one magnet having a magnetic strength sufficient to retain the first pin to the bench block.

3. The block of claim 1, wherein the at least one magnet is embedded in the at least one of the receiving core and the non-slip frame.

4. The block of claim 1, wherein the at least one magnet is adhered to the at least one of the receiving core and the non-slip frame.

5. The block of claim 2, wherein the at least one magnet is positioned to retain the first pin to the non-slip frame.

6. The block of claim 1, wherein the bottom edge of the non-slip frame, when resting against the flat surface, substantially frictionally prevents slippage of the firearm bench block relative to the flat surface.

7. The block of claim 1, wherein the receiving core further defines, on the bottom side, a barrel bushing wrench.

8. The block of claim 1, wherein the block has a perimeter substantially shaped as a regular pentagon.

9. The block of claim 8, wherein the non-slip frame defines concave gripping recesses corresponding to every side of the regular pentagon of the block.

10. The block of claim 1, wherein the non-slip frame is overmolded around the receiving core, and the receiving core and the non-slip frame are structured and configured such that the non-slip frame and receiving core substantially cannot be non-destructively separated.

11. A firearm bench block, comprising:

a receiving core comprising a first material and having a top side and a bottom side:

the receiving core defining at least a first recess on the top side configured to securely receive a firearm component for performance of a maintenance operation; and the receiving core further defining at least a first hole positioned so that when the firearm component is securely received by the first recess of the receiving core, the first hole is aligned with a corresponding first pin of the firearm component, such that when the first pin is punched from the firearm component, the first pin can pass into the first hole from the top side;

a non-slip frame comprising a second material and structured to substantially surround a perimeter of the receiving core, the non-slip frame further having a bottom edge that lays substantially in a plane, such that the bottom edge of the non-slip frame, when resting against a flat surface, substantially frictionally prevents slippage of the firearm bench block relative to the flat surface.

12. The block of claim 11, wherein the first hole is a through-hole, such that when the first pin is punched from the firearm component, the first pin can pass through the first through-hole from the top side to the bottom side of the receiving core.

13. The block of claim 11, wherein the bottom edge of the non-slip frame is displaced from the bottom side of the receiving core such that when the bottom edge of the non-slip frame rests against a flat surface, the non-slip frame can retain loose small parts to a space bounded at least by the non-slip frame and the flat surface.

14. The block of claim 11, further comprising at least one magnet integrated with either the receiving core or the non-slip frame, the at least one magnet having a magnetic strength sufficient to retain the first pin to the bench block.

15. The block of claim 14, wherein the at least one magnet is positioned to retain the first pin to the first hole.

16. The block of claim 14, wherein the at least one magnet is positioned to retain the first pin to the non-slip frame.

17. The block of claim 11, further comprising a threaded T-handle tool structured and configured to cooperate with a complementary tapped receiving opening of the receiving core, the receiving core being structured and configured such that a AR-15 bolt can be received by the receiving core and the threaded T-handle tool can be advanced into the tapped receiving opening to apply tension to a bolt ejector of the AR-15 bolt.

18. The block of claim 11, wherein the receiving core includes recesses configured to receive an AR-15 bolt, an AR-15 lower receiver, an AR-15 upper receiver, an AR-15 front sight, and an AR-15 charging handle.

19. The block of claim 18, wherein the receiving core includes recesses configured to receive at least one of the AR-15 bolt, AR-15 lower receiver, AR-15 upper receiver, AR-15 front sight, and AR-15 charging handle in more than one orientation.

* * * * *